US005816409A

United States Patent [19]

Baker et al.

[11] Patent Number: 5,816,409

[45] **Date of Patent: *Oct. 6, 1998**

[54] MOLDED PULP FIBER INTERIOR PACKAGE CUSHIONING STRUCTURES

[75] Inventors: Roger J. Baker, Portland; Matthew P. Noel, Windham; Brian C. McCullough, Standish, all of Me.

[73] Assignee: Moulded Fibre Technology, Inc., Westbrook, Me.

[ * ] Notice: The portion of the term of this patent subsequent to Aug. 6, 2012, has been disclaimed.

[21] Appl. No.: 524,965

[22] Filed: Sep. 8, 1995

Related U.S. Application Data

[63] Continuation of Ser. No. 249,014, May 25, 1994, abandoned, Division of Ser. No. 927,061, Aug. 6, 1992, Pat. No. 5,335,770.

[51] Int. Cl.[6] ..... B65D 81/06

[52] U.S. Cl. ..... 206/587; 53/452; 206/433; 206/592

[58] Field of Search ..... 206/433, 517–521, 206/523, 564, 581, 587, 591, 592; 217/21, 26.5; 220/339; 229/2.5 EC, 2.5 R, 406, 407; 53/452

[56] References Cited

U.S. PATENT DOCUMENTS

| | | | |
|---|---|---|---|
| D. 143,042 | 11/1945 | Shepard | D58/16 |
| D. 150,758 | 8/1948 | De Reamer | D58/13 |
| D. 249,638 | 9/1978 | Chadbourne | D9/189 |
| D. 253,506 | 11/1979 | Vigue | D6/191 |
| D. 254,956 | 5/1980 | Gilley | D9/184 |

(List continued on next page.)

FOREIGN PATENT DOCUMENTS

| | | |
|---|---|---|
| 680 198 | 2/1964 | Canada . |
| 727 439 | 2/1966 | Canada . |
| 753 853 | 3/1967 | Canada . |
| 793 649 | 9/1968 | Canada . |
| 1 064 867 | 10/1979 | Canada . |

(List continued on next page.)

OTHER PUBLICATIONS

Exhibit A.
Exhibit B.
Exhibit C.
Exhibit D.
Exhibit E.

(List continued on next page.)

*Primary Examiner*—Jimmy G. Foster
*Attorney, Agent, or Firm*—Testa, Hurwitz & Thibeault, LLP

[57] ABSTRACT

New molded pulp and molded fiber structures provide interior package cushioning to protect products shipped in a package. The molded pulp fiber interior package cushioning (IPC) structure defines a cavity for receiving and holding a product to be shipped. The IPC structure incorporates a plurality of structural ribs in the form of elongate hollow ridges molded in the IPC structure and extending between different locations for reinforcing the IPC structure between the locations. The IPC structure comprises intersecting ribs extending in at least two orthogonal directions or axes. The ribs are crushable structures positioned and distributed around the cavity for protecting a product in the cavity by crushing and absorbing energy in response to mechanical shock acceleration caused by impacts and vibration accelerations imparted by transport modes, for accelerations approaching a design limit or threshold acceleration at which damage or breakage may occur to a sensitive element of the product shipped in the package. The IPC structure also incorporates a plurality of structural pods in the form of hollow recesses or wells substantially symmetrical in cross section and molded with selected depths in the IPC structure at different locations. The pods are also crushable structures positioned and distributed around the cavity to provide additional protection for a product.

43 Claims, 13 Drawing Sheets

U.S. PATENT DOCUMENTS

| | | | |
|---|---|---|---|
| D. 339,983 | 10/1993 | Breton et al. | D9/347 |
| 2,564,729 | 8/1951 | Shepard | 206/65 |
| 2,575,192 | 11/1951 | Shephard | 229/2.5 |
| 2,774,473 | 12/1956 | Williams | 206/65 |
| 2,808,189 | 10/1957 | Williams | 229/14 |
| 2,813,652 | 11/1957 | Parsons | 217/26.5 |
| 3,028,065 | 4/1962 | Reifers | 229/2.5 |
| 3,129,866 | 4/1964 | Wade, Jr. | 229/2.5 |
| 3,163,312 | 12/1964 | Chaplin | 217/26.5 |
| 3,282,458 | 11/1966 | Rudd | 217/26.5 |
| 3,327,918 | 6/1967 | White | 229/2.5 |
| 3,343,702 | 9/1967 | Leitzel | 217/26.5 |
| 3,351,266 | 11/1967 | Reifers | 229/43 |
| 3,362,605 | 1/1968 | Bixler | 229/2.5 |
| 3,375,966 | 4/1968 | Crabtree | 229/2.5 |
| 3,477,564 | 11/1969 | Crabtree | 206/65 |
| 3,647,132 | 3/1972 | Crabtree | 229/2.5 |
| 3,677,201 | 7/1972 | Chadbourne et al. | 108/58 |
| 3,695,479 | 10/1972 | Crabtree | 217/26.5 |
| 3,702,100 | 11/1972 | Wharton | 108/58 |
| 3,708,084 | 1/1973 | Bixler et al. | 217/26.5 |
| 3,732,976 | 5/1973 | Bessett et al. | 206/65 |
| 3,765,592 | 10/1973 | Chadbourne | 229/2.5 |
| 3,778,516 | 12/1973 | Cornelius | 206/46 |
| 3,843,009 | 10/1974 | Emery | 217/26.5 |
| 3,885,728 | 5/1975 | Gilley | 229/2.5 |
| 3,904,103 | 9/1975 | Chadbourne | 229/2.5 |
| 4,059,219 | 11/1977 | Reifers | 229/2.5 |
| 4,087,040 | 5/1978 | Bessett et al. | 229/2.5 |
| 4,427,730 | 1/1984 | Robbins et al. | 428/156 |
| 4,448,344 | 5/1984 | Lord et al. | 229/2.5 |
| 5,244,094 | 9/1993 | Graff et al. | 206/564 |
| 5,316,173 | 5/1994 | Emery | 220/556 |

FOREIGN PATENT DOCUMENTS

| | | |
|---|---|---|
| 126 369 | 11/1973 | Denmark . |
| 0 439 823 A1 | 8/1991 | European Pat. Off. . |
| 2 052 427 | 1/1981 | United Kingdom . |
| 2 107 284 | 4/1983 | United Kingdom . |

OTHER PUBLICATIONS

Exhibit F.
Exhibit G.
Exhibit H.
Exhibit I.
Exhibit J.
Exhibit K.
Exhibit L.
Exhibit M.
Exhibit N.
Exhibit O.
Exhibit P.
Exhibit Q.
Exhibit R.
Exhibit S.
Exhibit T.
Exhibit U.
Exhibit V.
Exhibit W.
Exhibit X.
Exhibit Y.
Exhibit Z.
Exhibit AA.
Exhibit AB.
Exhibit AC.
Exhibit AD.

MOLDED PULP FIBER INTERIOR PACKAGE CUSHIONING STRUCTURES

This is a continuation of application Ser. No. 08/249,014 filed on May 25, 1994, abandoned, which itself is a divisional of application Ser. No. 07/927,061 filed on Aug. 6, 1992, U.S. Pat. No. 5,335,770.

TECHNICAL FIELD

This invention relates to new interior package cushioning (IPC) structures for protecting products shipped in a package from mechanical shock caused by corner drops, edge drops, face drops and horizontal impacts of the package, and from vibrations imparted by different transport modes during shipping and distribution. The invention provides new molded pulp fiber IPC structures which replace plastic foam interior package cushioning material. The IPC structures are molded with new crushable cushioning structures in new geometrical configurations designed to absorb impact shocks, critically damp vibrations, resist bending and hinging, support and direct loading and stacking forces around product containing cavities, and generally cushion and protect products shipped in a package. The molded pulp fiber IPC structure invention provides improved interior package cushioning characteristics in comparison with conventional plastic and plastic foam structures and conventional molded pulp fiber structures.

BACKGROUND ART

The predominant interior package cushioning material currently used in the packaging of products for shipping and distribution is plastic. Such plastic cushioning materials include a variety of polyethylene foams, moldable polyethylene copolymer foam, expanded polyethylene bead foam, styrene acrylonitrile copolymer foam, polystyrene foams, polyurethane foams, etc. Such plastic materials and plastic foams may be molded in place or molded to specific interior package cushioning structure shapes. The plastic may be formed in pieces to provide loosefill. Sheets of plastic film may be bonded together encapsulating bubbles of air to provide cushioning material. Such plastic interior package cushioning materials are described for example in Brandenburg and Lee, *Fundamentals of Packaging Dynamics,* MTS Systems, P.O. Box 24012, Minneapolis, Minn. 55424 (1985), Singh, Charnnarong, and Burgess "A Comparison Between Various Package Cushioning Materials", *IOPP Technical Journal,* (Journal of the Institute of Packaging Professionals) Winter 1992 issue, pages 28–36, and U.S. Pat. Nos. 5,096,650 and 4,792,045.

There are two major disadvantages associated with plastic cushioning materials and plastic interior package cushioning structures. Disposable packaging is a major contributor to the nation's municipal solid waste. It is estimated that packaging constitutes approximately one third by volume of all municipal solid waste and 8% of this amount is made up of the cushioning materials. The plastic cushioning materials are generally neither biodegradable nor compostable and therefore remain a long term component of the solid waste accumulation problem.

Furthermore because of the nature of plastic molecules the plastic interior package cushioning structures are characterized by irreducible spring constant parameters that may be detrimental to product cushioning and to product protection from mechanical shock and vibration during shipping and distribution of packaged products. Plastic foam materials may be inherently limited in the reduction that can be achieved for rebound, coefficient of restitution, and elasticity. As a result, the plastic cushioning materials may be implicated in resonance conditions which increase the shock amplification factor of the package system and link the shock acceleration, change of velocity and displacement with a product contained in the package. With respect to mechanical shock and impact imparted to a package by corner drops, edge drops and face drops, falling onto the floor and horizontal impacts, the plastic interior package cushioning structures of the product/package system may, if such resonance conditions occur, contribute to undesirable shock transmission and shock amplification. The shock amplification factor introduced by plastic cushioning materials may actually increase the shock accelerations, changes in velocities, and displacements experienced by a product.

Similarly with respect to mechanical vibrations imparted by shipping vehicles and other transport modes, the plastic interior package cushioning structures of the package/product system may under resonance conditions contribute to vibration magnification or transmissibility. The vibration magnification factor of plastic cushioning materials may result in a multiples increase in the vibration accelerations, changes in velocity, and displacements experienced by the packaged product. Again, it is the characteristics of plastic cushioning materials that contribute to resonance conditions enhancing the vibration magnification factor and linking the forcing vibrations of the transport mode with a product inside the package.

Another disadvantage of plastic foam interior package cushion structures is that the inherent rebound, coefficient of restitution, modules of elasticity, and spring constant characteristics of the plastic materials are an impediment to achieving critical damping structures for critically damping mechanical shocks and shipping vibrations. The plastic foam filled spaces conventionally used in product packaging may contribute to conditions of overdamping or underdamping with excessive transmissibility of mechanical shock and vibration accelerations, changes in velocity, and displacements to the packaged product.

Molded pulp fiber has previously been used in packaging structures described in U.S. Pat. Nos. 5,096,650; 4,742,916; 4,480,781; 4,394,214; 3,718,274; 3,700,096; 3,286,833; 3,243,096; 2,704,268. For example, Keyes Fiber Company, College Avenue, Waterville, Me. 04901 manufactures molded fiber fluorescent tube trays used in shipping fluorescent tubes stacked in a package. The fluorescent tube trays are formed with recesses complementary with the cylindrical fluorescent tubes. However these prior art fluorescent tube trays function only as dividers for preventing glass to glass contact. To the extent that the fluorescent tube trays can be described as being formed with recesses or ribs, the recesses only perform an indexing function for separating the tubes from one another.

The Keyes Fiber Company fluorescent tube trays do not perform a stacking function in the sense of directing stacking forces around product receiving recesses. Rather the tube trays do not contact each other and the stacking forces bear directly on the fluorescent tubes. Furthermore the fluorescent tube trays do not perform a design cushioning or design protection function. They are not designed to crush and absorb energy at package accelerations caused by mechanical shock and vibration which approach a specified design threshold or limit of mechanical shock and vibration acceleration at which damage or breakage may occur to a sensitive element of the fluorescent tube products shipped in the package. The utility of such fluorescent tube trays is exhausted by the dividing, indexing and separating functions only.

Another common molded pulp fiber package structure is the egg crate. Egg crates are typically formed with egg pockets for containing, indexing and separating the eggs. Resilient pillow pads or buttons may be formed in the bottom of egg pockets to "cradle" eggs in the egg pockets. The egg crate cover rests on "posts" formed at the intersections between egg pockets for bearing stacking forces so that egg crates may be stacked. However, the egg pockets and related structures of a conventional egg crate are not designed to crush and absorb energy for protecting eggs at package design limit or design threshold accelerations. Conventional egg crates do not incorporate crushable structures intended to crush and absorb energy at package accelerations from mechanical shock and vibration which approach a specified design threshold or limit at which damage or breakage may occur to eggs. The primary purpose for egg crates as for molded pulp fiber apple flats and other molded pulp fiber trays for food products is for indexing, dividing, orienting, and separating products from contact with each other. On the other hand, the present invention is directed to molded pulp fiber packaging structures specifically intended, designed, and constructed to meet predictable and reliable design specifications and cushioning requirements for protecting products shipped in a package from specified levels of mechanical shock and vibration accelerations at which damage or breakage may occur to a sensitive element of products shipped in a package.

Packaging structures have also been manufactured by so-called "slush molding" from a Kraft fiber based raw material slurry. Such Kraft fiber slush molded packaging structures are manufactured by Fibercel Inc. of Portville, N.Y. The heavy Kraft fiber structures are vacuum molded by "candle dipping", that is by immersion of the vacuum molding head multiple times in the slurry. A disadvantage of the slush molded package structures is that they are relatively rigid structures that are not predictably crushable. They cannot crush and absorb energy at reliable specified design limits or thresholds of mechanical shock and vibration acceleration. They are primarily intended for blocking and bracing and also are not suitable for nesting because of the mass of the slush molded structures.

OBJECTS OF THE INVENTION

It is therefore an object of the present invention to provide new interior package cushioning structures based upon molded pulp and molded fiber materials rather than plastic polymer molecules and materials. The molded pulp and molded fiber IPC structures may be molded from recycled cellulose fibers to provide environmentally sound recyclable, biodegradable, and compostable interior package cushioning structures.

Another object of the invention is to construct new interior package cushioning structures from natural materials such as fiber having inherently lower properties and parameters of rebound, coefficient of restitution, modulus of elasticity, and spring constant than is typically characteristic of plastic polymer molecules. The new IPC structure molded natural fiber material affords improved opportunity for avoiding shock amplification or vibration magnification. The new relatively inelastic fiber materials are particularly suited for critically damping mechanical shocks and shipping vibrations.

A further object of the invention is to provide new molded hollow crushable cushioning structures for absorbing and damping shocks and vibrations by the strategic shapes, configurations and placement of the hollow crushable cushioning structures as well as the inelastic properties of the materials composing the structures. Thus the invention relies upon the novel cushion structure shapes and configurations to achieve the desired characteristics of reduced rebound, coefficient of restitution, modulus of elasticity, and spring constant in addition to the inherent inelastic molecular properties of the material itself.

The invention seeks to achieve a new result using molded pulp fiber materials including recycled fiber. The objective is to provide molded pulp fiber interior package cushioning (IPC) structures that predictably and reliably meet design specifications and cushioning requirements for protecting a product shipped in a package from specified mechanical shock and vibration accelerations. The invention must typically protect a sensitive element of a product which is subject to damage or breakage if shock acceleration or vibration acceleration is transmitted to the product and sensitive element equal to or grater than a design limit or threshold. This design limit is typically specified in "g's", i.e., multiples of the acceleration "g" due to gravity on the Earth.

Specifically the invention meets such design specifications and requirements by deploying geometric shapes and configurations in molded pulp fiber IPC structures which provide the requisite crushability and cushioning absorption of energy at shock accelerations and vibration accelerations imparted to a package approaching the design threshold or design limit of shock acceleration or vibration acceleration at which damage or breakage may occur to the sensitive element of a product.

The invention is intended to meet such design requirements reliably and predictably according to ASTM test procedures and standards, and test procedures of the National Safe Transit Association (NSTA).

DEFINITIONS FOR THE DISCLOSURE OF THE INVENTION

IPC Structure

An IPC structure according to the invention is a molded pulp fiber internal or interior package cushioning structure used to protect products during shipping in a package. The IPC structure is generally formed with a cavity to receive a product. Cushioning structures such as crushable ribs, pods, rows of pods, podded ribs, etc. are molded in the IPC structure around the cavity. IPC structures also include corner protectors and insert protectors which are not necessarily formed with a cavity and which are added to a package to provide supplementary protection of products shipped in a package.

Package

A package is the external container for shipping products. Products are first placed in the cavities of IPC structures. The product enveloping IPC structures are then stacked in a package although an individual or single product enclosed or surrounded by IPC structures may also be shipped in a package.

Cavity

A cavity or pocket is a space with walls molded in the molded pulp fiber IPC structure to receive and hold a product to be shipped in a package. The cavity generally has an unusual or irregular configuration, custom shaped to accommodate a particular product. The cavity walls may incorporate shapes such as shelves, gables, shallow cones, and arches which reinforce the cavity walls to protect a product and transmit stacking and loading forces around a product in the cavity. The cavity is generally surrounded by one or more of the new molded pulp fiber crushable cushioning structures such as ribs, pods, rows of pods, podded ribs, etc. molded in the IPC structure.

Ribs

Ribs are elongate hollow ridges molded in the IPC structure, extending or "bridging" between different locations on the IPC structure for "crushable" reinforcement between the locations. Ribs are positioned around a cavity to provide product protection from mechanical shock, vibrations, and stacking and loading forces, and sometimes to avert bending or hinging. Ribs are crushable structures which crush and absorb energy at package accelerations from mechanical shock and vibration which approach a specified design threshold or limit of mechanical shock and vibration acceleration at which damage or breakage may occur to a sensitive element of a product shipped in the package.

Anti-hinge ribs

Anti-hinge ribs are ribs formed at locations on the IPC structure which may be vulnerable to bending or hinging in order to resist such bending or hinging. Anti-hinge ribs may also perform a beam-like function in supporting a product retained in a cavity.

Pods

Pods are hollow recesses or wells substantially symmetrical in cross section molded with selected depths in the IPC structure. Pods are positioned at locations around a cavity to enhance product protection from mechanical shock, vibrations, and stacking and loading forces. Pods are generally tapered in cross section from a greater dimension at the opening of the recess or well to a smaller dimension at the bottom of the recess or well. Pods are crushable structures designed to crush and absorb energy at package accelerations from mechanical shock and vibration which approach a specified design threshold or limit of shock and vibration acceleration at which damage or breakage may occur to a sensitive element of a product shipped in the package.

Row of pods

A row of pods is a linear sequence of at least three pods spaced closely together with the distance between pods less than the width of a pod. An array of pods is a set of at least three pods spaced closely together not necessarily in a linear sequence. Fillets may be deposited in the valleys between the outside of adjacent pods to provide increased crush resistance, resistance to bending or hinging at joints between pods, for increased product protection, and for transmitting lateral forces around a cavity. Fillets may be used to adjust the crushability of a crushable row or array of pods over a range from high compliance crushing to structural rigidity according to the added mass of material. The fillets may also perform a denesting function to prevent locking of nested IPC structures.

Podded rib

A podded rib is a rib formed with a row of at least three rib pods along the rib. The depth of the rib pod is shallower than the depth of the rib. This distinguishes a podded rib from a row of pods. Fillets may be deposited between the rib pods of a podded rib as well as between the pods of a row of pods. A podded rib provides a rib which affords increased crush protection, increased product protection, diversion of stacking and loading forces, and resistance to bending and hinging.

Fillet

A fillet or gusset is an accumulation of molded pulp fiber deposited in the valley between the outsides of adjacent pods in a row of pods or a podded rib. Fillets can perform a reinforcing function for increased product protection, for transmitting stacking and loading forces, and for increased crush resistance and resistance to bending or hinging at joints between pods. Fillets can be used to adjust the level of crushability of crushable structures over a range from high compliance crushing and cushioning to structural rigidity. Fillets also provide a denesting function to avert locking of nested IPC structures.

Posts

Posts are pods of extended depth greater than the depth or width of a cavity. Posts generally perform a post-like function by supporting a product packed in a cavity and by transmitting stacking and loading forces around a product containing pocket or cavity to the base of a package. Posts are also crushable structures for responding to mechanical shock accelerations and vibration accelerations approaching a design limit or threshold for cushioning and protecting a product by crushing and by absorbing energy.

Shelves

Shelves are effectively half ribs taken in the elongate direction of a rib. Shelves are molded in the IPC structure and form a step structure between one level of an IPC structure and another level. Shelves are generally formed in the wall of a cavity to support a product, reinforce the cavity, transmit stacking and loading forces around the product, and increase product protection.

Scalloped edges or reinforced edges

Scalloped edges are edges of a molded pulp fiber IPC structure formed with periodic scallops or depressions to impart edge strength for increased resistance to crushing, increased product protection, and for transmitting lateral forces.

Stacking ribs and pods

Stacking ribs and pods are ribs and pods molded in the IPC structure at locations arranged for complementary abutting contact when IPC structures loaded with products are stacked back to back in a package. The stacking ribs and pods transmit stacking and loading forces around the product containing cavities to the base of the package.

Nesting

Nesting is the back to front interfitting placement of IPC structures on top of each other when facing in the same direction and without products in the respective cavities. IPC structures are nested to conserve space for shipping the internal package cushioning structures to product manufacturers for use in shipping products.

Stacking

Stacking is the interfitting back to back placement of IPC structures on top of each other in a package after loading products in the cavities. In stacking, the stacked IPC structures face in opposite directions. The manufacturer stacks product loaded IPC structures in a package for shipping.

Crush Rib and Friction Fit Pocket or Cavity

A friction fit or crush fit pocket or cavity is a pocket formed with protruding crush ribs that protrude into the pocket and define a width dimension sized slightly smaller than a width dimension of a product to be inserted in the pocket. A crush rib is a rib formed to protrude into a friction fit pocket and constructed to crush slightly when the product is pushed into the friction fit pocket. The crush rib and friction fit pocket combination has been found to impart excellent vibration damping characteristics to the package/product system for critically damping vibrations originating from the transport mode, for preventing vibration magnification, and for isolating a product from vibrations. When the product is forcibly inserted in the friction fit pocket, the pocket also expands stressing and partially separating fibers and further contributing to vibration isolation and protection of the product in the crush fit pocket.

Suspended Pocket or Suspension Pocket

A suspended pocket is a pocket or cavity suspended between two or more ribs, pods, or similar support structures to support a product in the pocket by suspension. The suspended pocket suspends and protects products so that no part of the product or suspending pocket touches the external container package or any other IPC structure during shipping and handling.

Rib Cage

A rib cage is a network of a plurality of intersecting crushable ribs extending in two or three orthogonal directions or axes around at least a portion of a cavity for protecting a product in a cavity from mechanical shock and vibrations.

Mechanical Shock

Mechanical shock is the abrupt motion imparted to a package by impact of the package with the floor in corner drops, edge drops and face drops, as well as by horizontal impacts during shipping and handling. Mechanical shock is characterized by rapid change in the acceleration, velocity and displacement of the package. A package shock may typically impart to the package a shock acceleration in the range of, for example, 150 g's (where g is the acceleration due to the earth's gravitational field) with a short duration in the range of for example 20 milliseconds (mS). Shock acceleration, change in velocity, and deflection generally refer to the maximum acceleration, change in velocity, and deflection or displacement imparted to the package by a shock pulse.

Shock Amplification and Shock Transmissibility

Shock amplification is the multiplication or enhancement of shock acceleration, change in velocity and deflection caused by the spring constant characteristics of the package/product system and particularly the interior package cushioning structures of the product/package system at or near a resonance condition. A resonance condition occurs when the frequency ($f_2$) of the shock pulse and a natural frequency ($f_1$) of the product package system substantially coincide. The amplification factor is the multiple increase in maximum shock acceleration, change in velocity and deflection experienced by a product or transmitted to a product by a package/product system and in particular by the interior package cushion structures as a result of a mechanical shock applied to a package. Shock amplification by the package/product system is also referred to as shock transmissibility of the package/product system.

Vibrations

Vibrations are the periodic or random motions imparted to a package by vehicles and transport modes during shipping and distribution of the package. The vibration acceleration, velocity, and displacement generally refer to the peak acceleration, velocity, and displacement imparted to a package by the shipping vibrations. Vibration accelerations are generally measured in g's, (units of the earth's gravitational acceleration).

Vibration Magnification and Vibration Transmissibility

Vibration magnification is the multiplication or enhancement in vibration acceleration, change in velocity, and displacement caused by the spring constant characteristics of the package/product system and particularly by the interior package cushioning structures of the product/package system at or near a resonance condition. A resonance condition occurs when the frequency ($f_f$) of the forcing vibrations of the transport mode and a natural frequency ($f_n$) of the product/package system substantially coincide. The vibration magnification factor is the multiple increase in vibration acceleration, change in velocity, and displacement experienced by a packaged product and links the vibrations of the transport mode to the product inside the package/product system.

Generally, the discussion of package dynamics and IPC structure dynamics set forth in this patent application specification follows the terminology and discussion found in Brandenburg & Lee, *Fundamentals of Packaging Dynamics,* cited above.

Crushable Structure

Crushable structures including ribs and pods according to the invention are hollow geometrical shapes and configurations distributed around product receiving cavities of IPC structures. The crushable structures are designed for crushability and cushioning absorption of energy at accelerations imparted to a package by mechanical shock and vibration approaching the design limit or threshold of shock and vibration accelerations at which damage or breakage may occur to a sensitive element of a product shipped in the package. The hollow crushable structures of molded pulp fiber material according to the invention are effectively inelastic upon crushing and cushioning absorption of energy thereby effectively eliminating rebound and coefficient restitution. Below the design limit or threshold, however the crushable structures retain some memory and recoverability to maintain the structure and integrity of the IPC structure. Crushability at or approaching the design limit in g's refers to the capability of crushing by fiber breaking, tearing, fracturing and pulling apart. Crushability may be viewed as a design characteristic selected or specified over a range from highly compliant crushing to structural rigidity. The crushability of crushable structures according to the invention is established by empirical methods to achieve product protection at the specified design limits or threshold of shock and vibration acceleration typically in a range from 20 g's to 200 g's.

DISCLOSURE OF THE INVENTION

In order to accomplish the "Objects of the Invention" summarized above, the invention provides a new structure for interior package cushioning to protect products shipped in a package. The interior package cushioning (IPC) structure is molded from pulp fiber and preferably recycled pulp fiber. In the primary examples the IPC structure defines a cavity or pocket custom shaped for receiving and holding a product to be shipped.

According to the invention a plurality of structural ribs are incorporated in the IPC structure in the form of elongate hollow ridges molded in the IPC structure extending between different locations on the IPC structure for crushable reinforcement of the IPC structure between the locations. The IPC structure incorporates different ribs extending in at least two orthogonal directions or axes relative to each other and intersecting with each other to form a crushable "rib cage". In some examples the ribs extend in three orthogonal directions along three axes with intersecting ribs. The ribs are positioned and distributed around at least a portion of the cavity of the IPC structure for protecting a product in the cavity from mechanical shock caused by corner drops, edge drops, face drops, and horizontal impacts of a package, for damping vibrations imparted by transport modes, and for transmitting stacking and loading forces around the cavity.

A feature of the invention is that the hollow ribs are crushable structures constructed for crushing and absorbing energy at accelerations caused by mechanical shock and vibration imparted to a package which approach a specified design limit or threshold acceleration at which damage or breakage may occur to a sensitive element of a product shipped in the package. The crushability and inelastic cushioning absorption of energy is established by empirical methods to assure predictable and reliable protection of products at the specified design limit of mechanical shock acceleration and vibration acceleration.

In the preferred embodiments the IPC structure also incorporates a plurality of structural pods in the form of hollow recesses or wells substantially symmetrical in cross section and molded with selected depths in the IPC structure at different locations. The pods are positioned and distributed around the cavity to provide additional protection for a product in the cavity from mechanical shock, vibrations, and stacking and loading forces. The pods are also crushable structures constructed for crushing and cushioning absorption of energy at mechanical shock accelerations and vibration accelerations approaching a design limit or threshold in "g's".

The structural pods may be arranged in a row of pods having at least three pods closely spaced in a linear sequence. The row of pods is positioned on the IPC structure to enhance product protection and to resist crushing. Typically the molded pods are tapered from a greater dimension at the opening of the recess or well of the pod to a smaller dimension at the bottom of the recess or well. The row of pods may be formed in a rib to form a podded rib of a row of at least three rib pods. The row of rib pods reinforces the podded rib to provide additional product protection by sequential crushability and sequential crushing and absorption of energy from a single impact or multiple impacts. Pods may also be formed in arrays to form a reinforced two dimensional grid. Rows of pods and arrays of pods may permit a package to bear multiple impacts at the design limit or threshold of "g's" while protecting the product from breakage or damage.

According to another feature of the invention, fillets of molded pulp fiber may be deposited in valleys between the outsides of adjacent pods to increase resistance to crushing and bending or hinging at the valleys between pods. Fillets may be used to add an additional level of crushable protection to the packaged products. Fillets may also be used to adjust the crushability of crushable structures. Ribs and pods molded in the IPC structure may be arranged for nesting of a plurality of IPC structures facing in the same direction thereby minimizing the space requirements for shipping the IPC structures without products in the cavities. In that application, the fillets also function as denesting fillets performing a denesting function to prevent locking of IPC structures. Denesting lugs may also be molded in the IPC structures to prevent locking engagement of nested IPC structures.

A variety of rib and pod structures are provided for performing a variety of functions. For example stacking ribs and pods are arranged for back to back mating of ribs and pods of adjacent IPC structures. The ribs and pods on the outside of one IPC structure rest on the ribs and pods on the outside of another for stacking of products retained in the cavities of the IPC structures. The ribs and pods are arranged to transmit stacking forces and loading forces through ribs and pods around the product containing cavities to the base of a package.

Other types of ribs include anti-hinge ribs formed at locations on the IPC structure to counteract hinging or bending motion at such locations. Crush ribs are formed to protrude into friction fit cavities to define a pocket width less than a width dimension of a product to be received in the pocket for imparting critical vibration damping and vibration isolating characteristics. Support ribs are provided to support a product in a suspended pocket between two locations. Elongate pods having a depth dimension greater than a cavity provide posts for transmitting stacking and loading forces around the cavity. A variety of crushable reinforcing cavity shapes are also disclosed.

The invention also provides IPC structures not necessarily formed with a cavity such as a corner protector structure to supplement the interior package cushioning. The molded pulp fiber IPC corner protector structure is constructed for positioning at corners of a package for protecting a product from mechanical shock, vibrations, and stacking and loading forces and for providing energy absorbing and cushioning crushability at the corners. The corner protector structure incorporates an array of a plurality of structural pods molded in the IPC corner protector structure in the form of hollow recesses or wells substantially symmetrical in cross section and molded with selected depths in the IPC corner protector structure. The pods are tapered from a greater dimension at the opening of the recess or well to a smaller dimension at the bottom of the recess or well.

According to the invention the array of pods includes a set of first pods molded with a first selected depth, and a set of second pods molded with a second selected depth less than the first selected depth. The array of pods affords a lesser resistance to crushing or lower acceleration level crushability by the first set of pods for absorbing shocks and vibrations, and a greater resistance to crushing and higher acceleration level crushability after the first set of pods are crushed to the depth of the second set of pods. Additional sets of pods may be incorporated in the array affording additional levels of crushability. The array of pods therefore provides an IPC corner protector structure with at least two different sequential levels of resistance to crushing and crushability by mechanical shocks, vibrations, and stacking and loading forces. The array of pods in the IPC corner protector structure may be formed with fillets of molded pulp fiber deposited in the valleys between the outsides of adjacent pods to provide yet a third level or greater level of crushability with increased resistance to crushing and to bending or hinging at the valleys between pods.

The invention also provides cavity IPC structures incorporating the array of multilevel pods for multiple levels of crushability. This feature of the invention is particularly applicable for IPC structures used in shipping heavy products with delicate or sensitive elements such as television sets and electronic equipment. According to this embodiment of the invention arrays of multilevel pods are molded directly in the IPC structure and distributed around the product receiving cavity. The array of pods with multiple depths or lengths are designed for crushing and absorbing energy at multiple design limits or thresholds of mechanical shock acceleration and vibration acceleration imparted to the package. The IPC structures respond by crushing at the successive levels. Furthermore fillets between the pods may be deposited to afford a final level of crushability.

Generally the invention provides crushable structures in the form of a variety of hollow geometrical shapes and configurations formed in molded IPC structures for crushing and cushioning absorption of energy at design limits and thresholds of mechanical shock accelerations and vibration accelerations imparted to a package. The crushable structures afford reliable and predictable product protection at the design limits and requirements. The crushability and cushioning absorption of energy is established by empirical and heuristic methods and procedures and ultimately satisfies design requirements for product protection according to ASTM and NSTA test procedures.

The adjustable parameters of the crushable structures such as ribs and pods available for adjustment to achieve design requirements for protection at specified g levels include the thickness of the molded pulp fiber walls, referred to as the gauge or caliper of the molded pulp fiber walls or shelves. According to the invention the caliper is generally in the range of 30–200 thousandths of an inch (0.030–0.200 inches) and more typically in the range of 30–95 thousandths of an inch (0.030–0.095 inches). Fillets may be used to increase the caliper or gauge to the higher level thickness of the range at selected locations such as the valleys between the outsides of pods. Varying the caliper of the shell and adding fillets may be used to increase material rigidity and change the crushability of the crushable structure over a range from compliant cushioning to structural rigidity.

Other factors in determining crushability include the depth and area of the crushable structures. Factors in determining the design crushability include the weight, size and area of the product to be protected, design drop height and design limit or threshold in g's at which breakage or damage may occur to a sensitive element of the product. Contents of the molded pulp fiber including fiber length and moisture content may also be a factor. The molded pulp fiber IPC structures of the invention are generally formed with a final moisture content of about 10%.

In the preferred example embodiments, the internal package cushioning structures are vacuum molded from a slurry of recycled fiber. The slurry of pulp fiber is formed by a major portion of newspaper, a minor portion of white ledger office paper to enhance fiber length, a vegetable base starch for a binding compound, and water. The mixture is repulped to provide the slurry of recycled pulp fiber from which the IPC structures are molded by vacuum molding machines.

For example, one recipe for a molded pulp fiber slurry according to the invention is as follows. Seventy pounds of newspaper/newsprint, thirty pounds of white ledger office paper, two pounds of potato base starch, and two hundred forty gallons of water are added to a rotary pulping tank. The rotor pulps the mixture for example for twenty minutes after which it is transferred to a holding tank for use as the vacuum molding slurry. The vacuum molding heads immersed in the slurry are generally of the type with a perforated screen surface for distributing negative pressure for molding and positive pressure for releasing a molded article.

Other objects, features and advantages of the invention are apparent in the following specification and accompanying drawings.

DETAILED DESCRIPTION OF PREFERRED EXAMPLE EMBODIMENTS AND BEST MODE OF THE INVENTION

An internal package cushioning structure for shipping bottles in a bottle shipping package is illustrated in FIGS.

Figure 1:
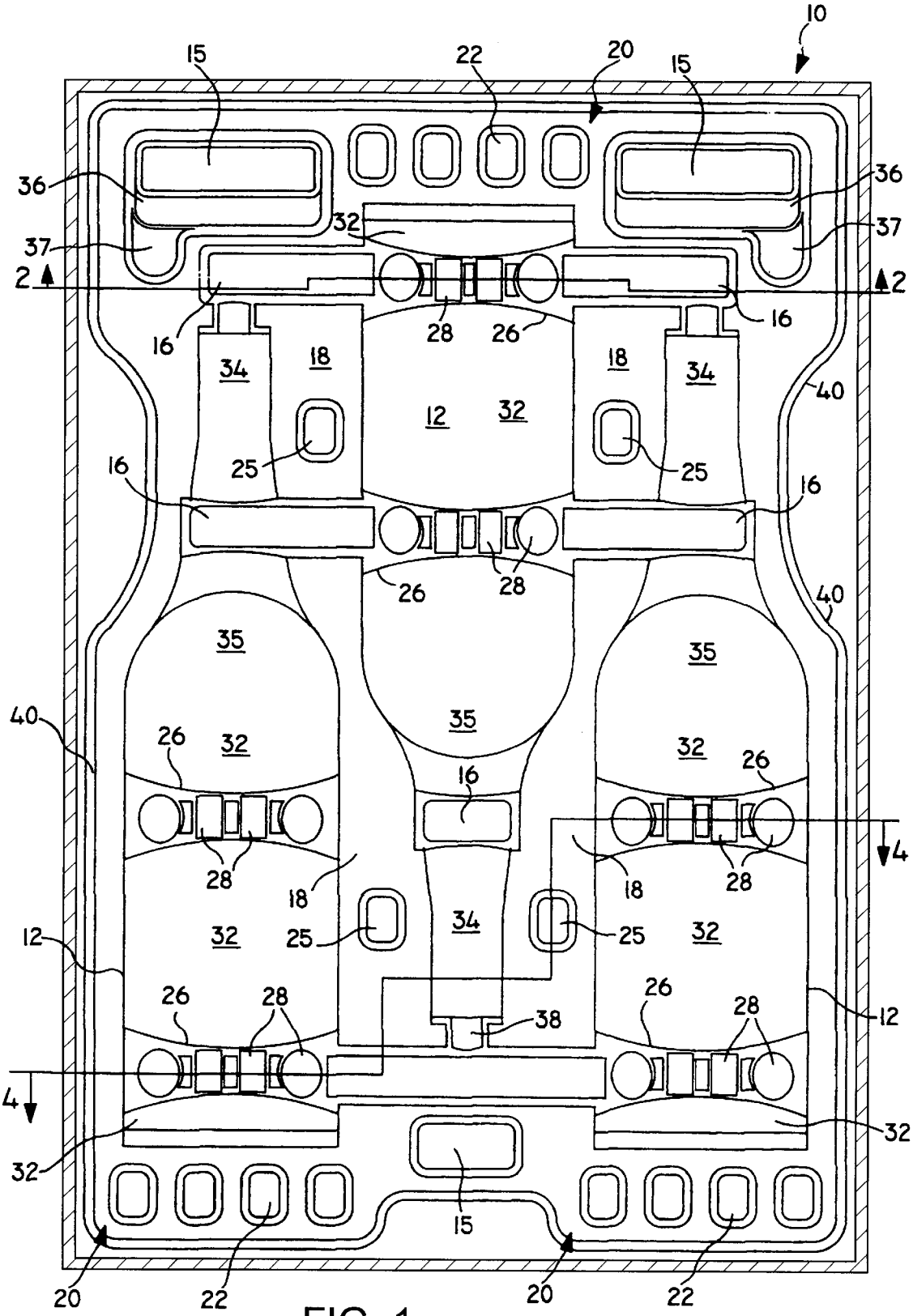
FIG. 1 is a plan view from above of the lower half of a molded pulp fiber IPC structure formed with multiple cavities for receiving and holding bottles for bottle shipping packages.
Figure 2:
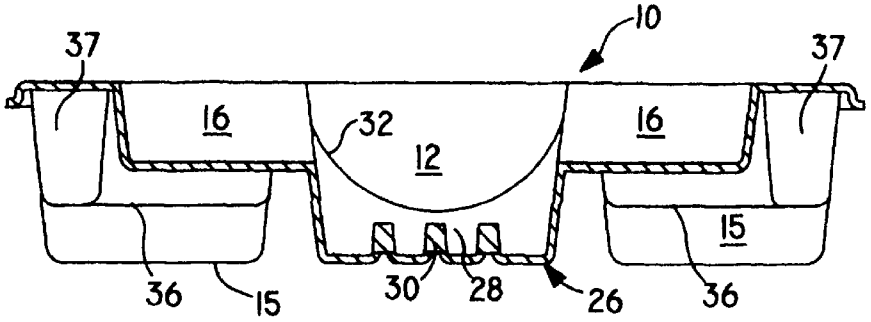
FIG. 2 is an end cross sectional view in the direction of the arrows on line 2—2 of FIG. 1.

1–4. The internal package cushioning structure is particularly adapted for shipping wine bottles in a wine bottle shipping package. The lower half 10 of the IPC structure is illustrated in FIGS. 1,1A and 2 and is formed with half cavities 12 for receiving three wine bottles in a single tier or level. An upper half of the IPC structure, not shown in FIGS. 1 and 2, but identical to the lower half IPC structure 10 in a mirror image orientation, is then placed over the top to complete the tier of three wine bottles. Multiple tiers are then stacked back to back as hereafter described with reference to FIGS. 3 and 4 to form a multi-tier wine bottle shipping package.

As further illustrated in FIGS. 1 and 2, the half IPC structure 10 is formed with numerous elongate cross ribs including end ribs 15 positioned at respective ends of the bottle receiving cavities 12 and mid-ribs 16 positioned at interior locations along the cavities 12. The cross ribs 15,16 are distributed at locations around the cavities from one end to the other with the elongate directions of the ribs 15,16 oriented across the elongate direction of the IPC structure 10 and cavities 12 (i.e. along the left/right axis in FIGS. 1 & 2). The half IPC structure 10 is also formed with elongate longitudinal ribs 18 between the cavities 12 oriented with the respective elongate directions along the elongate direction of the cavities 12 and IPC structure 10 (i.e. along the top/bottom axis as shown in FIG. 1). The end ribs 15, mid ribs 16, and longitudinal ribs 18 are distributed around the cavities 12 to afford protection of bottles housed in the cavities 12 from impact shocks and transportation mode vibrations.

Rows 20 of pods 22 are also formed at the ends of the wine bottle shipping package IPC structures 10. The rows 20 are formed at alternately opposite ends of the cavities coinciding with the bottom end of bottles retained in the cavities 12. It is noted that the end ribs 15 are also formed at alternately opposite ends of the cavities 12 coinciding with the top ends of bottles retained in the cavities 12. The rows of pods substantially enhance product protection and perform a stacking function hereafter described. In the rows 20, fillets of pulp fiber material may be deposited between the outsides of adjacent pods 22 further reinforcing the rows 20 and resisting bending or hinging at the valleys between the pods 22. Individual pods 25 are also distributed through interior locations of the IPC structure 10, particularly in the interior longitudinal ribs 18 adjacent to cavities 12 for increased product protection.

The IPC structure 10 of FIGS. 1–4 is also formed with podded ribs 26 incorporating respective rows of pods 28. The depth of the rib pods 28 is less than the overall depth of the rib 26 so that the overall resulting structure is a reinforced rib. The rows of rib pods 28 confer particular strength to the podded ribs 26 in the form of crushable reinforcement for protecting bottles in the cavities from impact shock and vibrations and for directing stacking and loading forces around the cavities. The podded ribs 26 are distributed at intervals along the cavities 12 at interior locations of the IPC structure 10.

For purposes of stacking, the podded ribs 26 are distributed at alternately opposite lower mid cavity locations. The stacking locations and depths are hereafter described in further detail. The rib pods 28 are also formed with fillets 30 of the molded pulp fiber material deposited in the valleys between the outsides of the rib pods for further reinforcement of the podded ribs 26.

The cavities 12 also incorporate reinforcing cavity shapes. In the example of FIGS. 1 & 2, the cavities or pockets 12 are formed with molded pulp fiber arches 32 between ribs 16,26 and between ribs 26 and pod rows 20, conforming to the cylindrical shape of the bottle. The neck receiving portion of the cavity is formed with a narrowed arch 34 and a spherical arch region 35 of compound curvature joins the cylindrical arch shapes 32,34 of different diameter. Overall the arches 32,34, and 35 form a cavity in the configuration of an elongate rib 32,35,34, perpendicular to and intersecting the cross ribs 15,16 and podded ribs 26.

Other structural features of the bottle shipping package half IPC structure 10 include shelves 36 and 37 formed adjacent to and reinforcing the end ribs 15. Coupling shelves 38 connect the top end of the bottle cavities 12 to end ribs 16. The lower ends of bottle cavities are supported by the end rows 20 of pods 22. A folded rib edge 40 is formed around the entire perimeter of the IPC structure 10 for edge strength.

Figure 3:
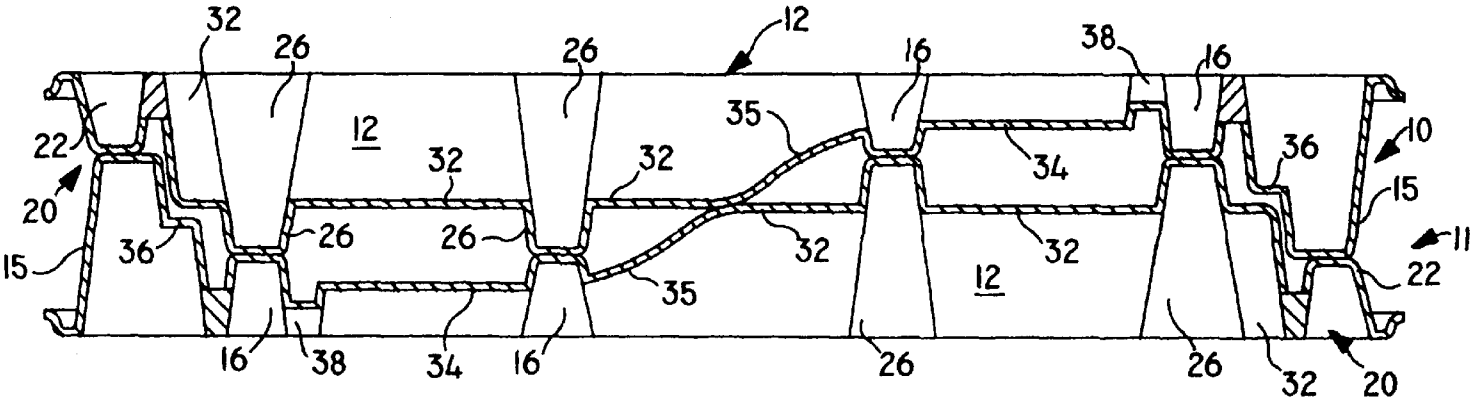
FIG. 3 is a side cross section view of two back to back bottle shipping package half IPC structures including an upper half and a lower half in a stacking configuration. Respective stacking ribs and pods are in abutting alignment for directing stacking and loading forces around the respective bottle receiving cavities. The side cross sectional view is taken along the center line of the outer cavities in the elongate direction.
Figure 4:
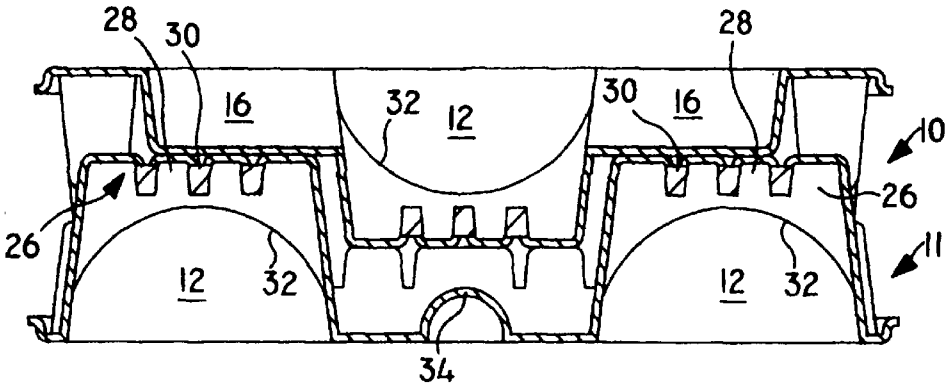
FIG. 4 is an end cross sectional view of the two back to back bottle shipping package half IPC structures in the direction of the arrows on line 4—4 of FIG. 1.

An important feature of the bottle shipping package half IPC structure 10 shown in FIGS. 1–4 is the construction and arrangement of the cross ribs including end ribs 15, interior ribs 16, rows 20 of pods 22, and podded ribs 26 for stacking of tiers of bottles in the shipping package. As shown in FIGS. 3 and 4, the podded ribs 26 at the lower half or lower mid section of a bottle cavity 12 of a first half IPC structure 10 are aligned with interior cross ribs 16 at the upper half or upper mid section of an adjacent cavity 12 of a second half IPC structure 11 rotated 180° for stacking. The depths of the podded ribs 26 and cross ribs 16 are selected for abutting each other and transmitting stacking and loading forces around the product containing cavities in the back to back stacking relationship. In the configuration of FIGS. 1–4, it is noted that four sets of complementary aligned mating podded ribs 26 and interior cross ribs or mid ribs 16 form four stacking support rows extending completely across the back to back IPC structures 10,11. The four stacking support rows are substantially evenly distributed along the length of the interior of the back to back IPC structures 10,11. In each of these four interior stacking support rows, podded ribs 26 abut against interior ribs 16 and visa versa.

Additionally, two partial stacking support rows are formed at the respective ends of the back to back IPC structures 10,11 formed by the abutting faces of end ribs 15 and end rows 20 of pods 22. As shown in FIGS. 3 and 4 the end ribs 15 are formed with sufficient depth to constitute stacking ribs abutting against the pods 22 of the rows 20 of the back to back abutting IPC structure 11. A total of six stacking support rows of abutting or mating podded ribs 26, mid portion cross ribs 16, end rows 20 of pods 22 and end ribs 15 provide ample support for the stacking and loading forces of multiple tiers of bottles, directing the stacking and loading forces to the base of the bottle shipping package.

By way of example the design requirement for the bottle shipping package IPC structure was selected so that the package could withstand impact shock acceleration of 67 g's or greater from edge drops, corner drops, face drops, and horizontal impacts without transmitting more than 67 g's to the product and without wine bottle damage or breakage. This is accomplished by deployment of the foregoing crushable structures in the geometrical shapes and configurations distributed about the cavities as illustrated in FIGS. 1–4. In ASTM and NSTA Test Procedure Project 1A it has been determined that this deployment of crushable structures affords a predictable and reliable crushability and cushioning absorption of energy to prevent product damage by mechanical shock accelerations imparted to a package which approach or exceed the design limits of 67 g's. In actual ASTM/NSTA test procedures it was determined that the bottle shipping IPC structures of FIGS. 1–4 reduce the shock accelerations transmitted to the bottles in comparison with conventional expanded polystyrene packaging structures from 114 g's to 67 g's for major package impacts.

In this example the molded fiber shell of the IPC structure is formed with a caliper of 60 thousandths of an inch (0.060") (0.15 cm). The pods of each of the row of pods and the rib pods of each of the podded ribs are formed approximately one eighth of an inch (0.3 cm) apart at the valleys or closest points of approach of adjacent pods. This in turn results in the formation of fillets between the pods of the rows of pods and the rib pods of the podded ribs forming an additional caliper thickness at the fillet locations of approximately 125 thousandths of an inch (⅛") (0.3 cm). The fillets adjust the crushability of the crushable structures to the desired range for achieving the design requirements of the package and IPC structures.

Figure 5A:
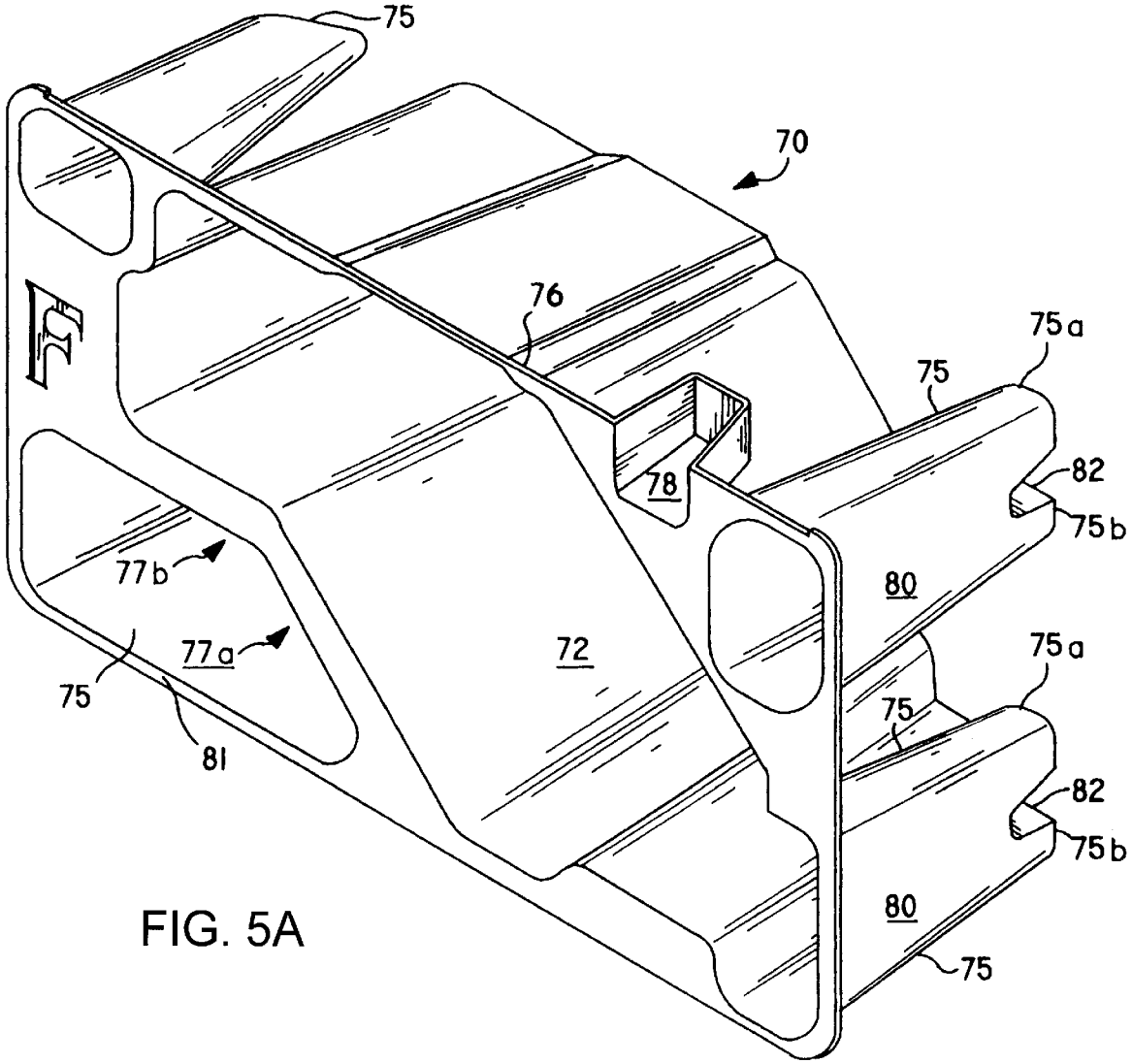
FIG. 5A is an isometric perspective view at an angle from above the laser printer toner cartridge end cap IPC structure.
Figure 5:
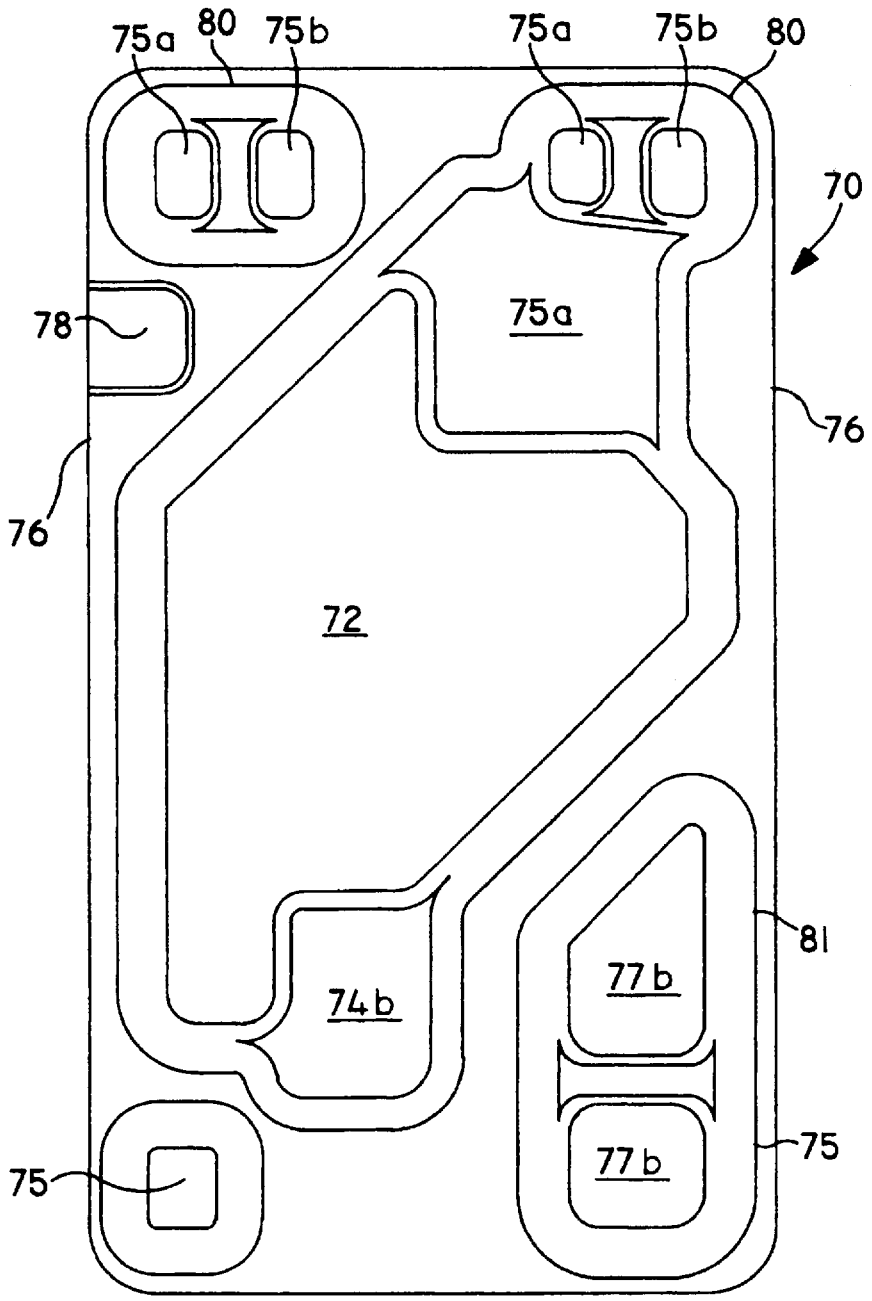
FIG. 5 is a plan view from above, of a laser printer toner cartridge end cap IPC structure for a toner cartridge shipping package.

A laser printer toner cartridge end cap IPC structure 70 for a toner cartridge shipping package is illustrated in FIGS. 5–8. As shown in FIGS. 5 and 5A, the end cap IPC structure 70 is formed with a cavity 72 of unusual configuration conforming to the unusual or irregular shape at the end of the toner cartridge. The deep cavity 72 is formed with various shelves 74*a*,74*b* to accommodate and support the irregular three dimensional shape. The base of the cavity is also formed around its perimeter with a variety of pods 75 which support the cavity and provide product protection from impact shocks and transport mode vibrations. The pods 75 also have portions extending the full depth of the cavity 72 so that the pods 75 form posts 80,81. The post like function of the pods 75 supports and directs stacking and loading forces around the cavity in the case of vertical orientation in the shipping package. For lateral or horizontal orientation the pods 75 provide product protection from horizontal impact shock and vibrations. The perimeter 76 at the top of the end cap IPC structure may also be formed with a recess or scallop at necessary locations to increase edge strength and product protection.

Figure 6:
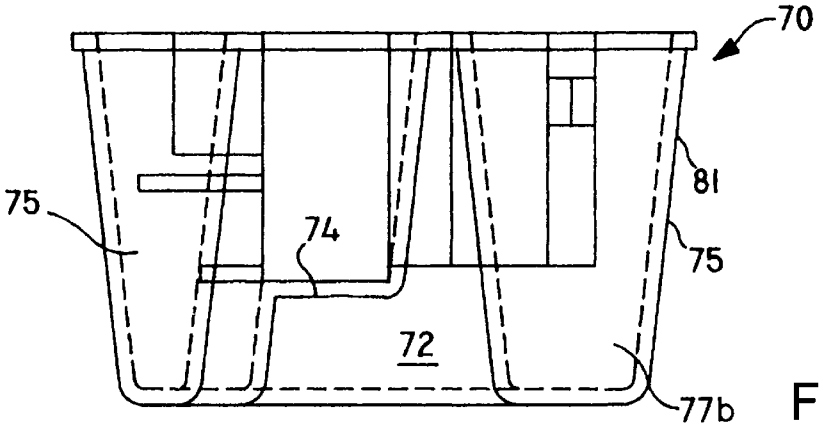
FIGS. 6 & 7 are an end view and side view respectively of the laser printer toner cartridge end cap IPC structure of FIG. 5.
Figure 7:
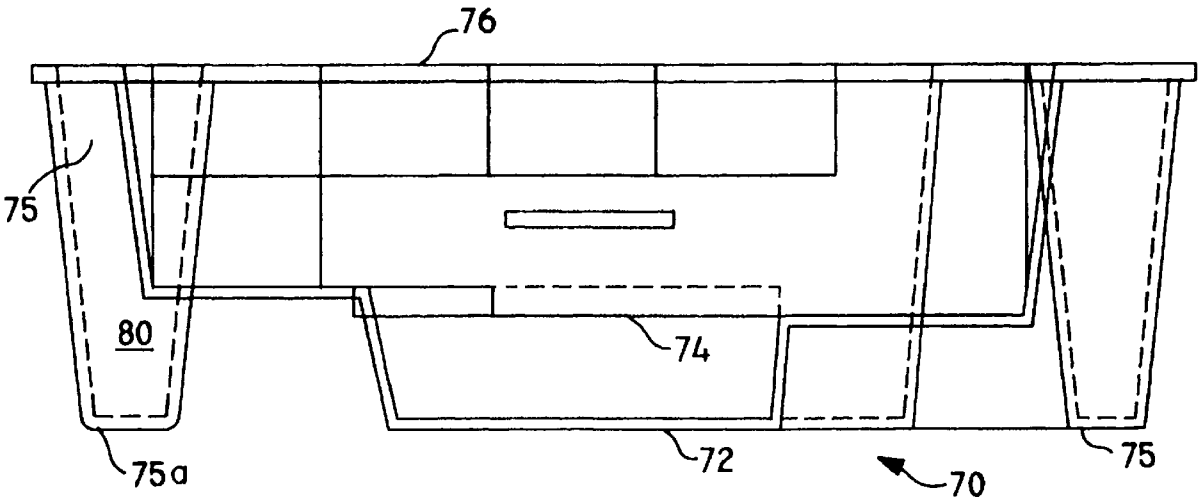

Referring to FIGS. 5 and 5A, it is apparent that in some instances the pods 75 are arranged as double pods 75*a*,75*b* of a single post 80. The advantage of this configuration is that fillets 82 of molded pulp fiber material may be deposited in the valley between the outsides of the double pods 75*a* and 75*b* to reinforce the post for adjusting the crushability of the posts and bearing greater crushing forces and lateral forces. The double pod post also reinforces the capacity of the posts 80 for directing stacking and loading forces. In the example of FIGS. 5–7, the end cap IPC structure is formed with double podded post 81 with relatively large area pods 77*a* and 77*b* at the fourth corner of the IPC structure.

Figure 8:
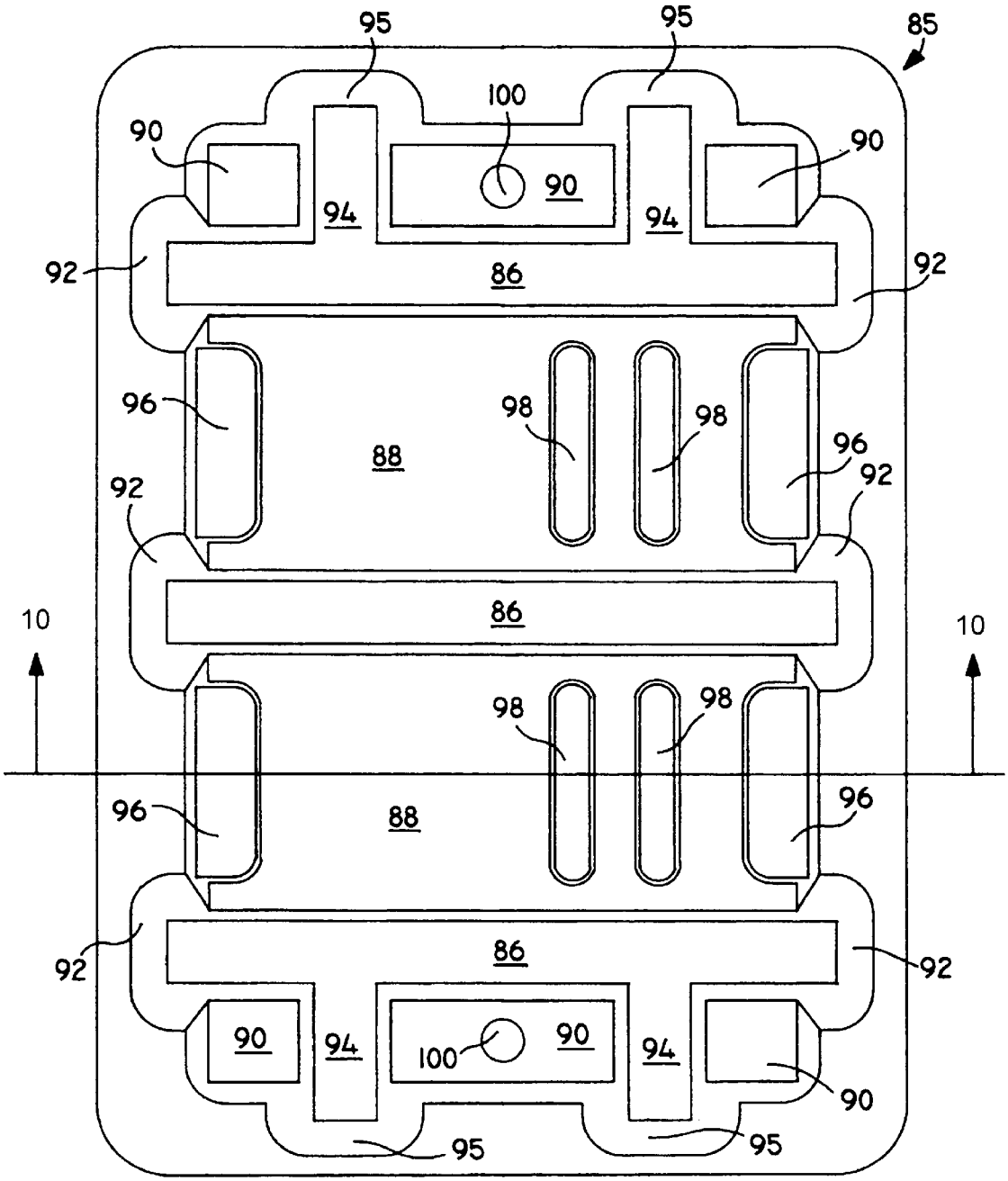
FIG. 8 is a plan view from above of an IPC structure with a speaker receiving cavity for a speaker shipping package.
Figure 9:
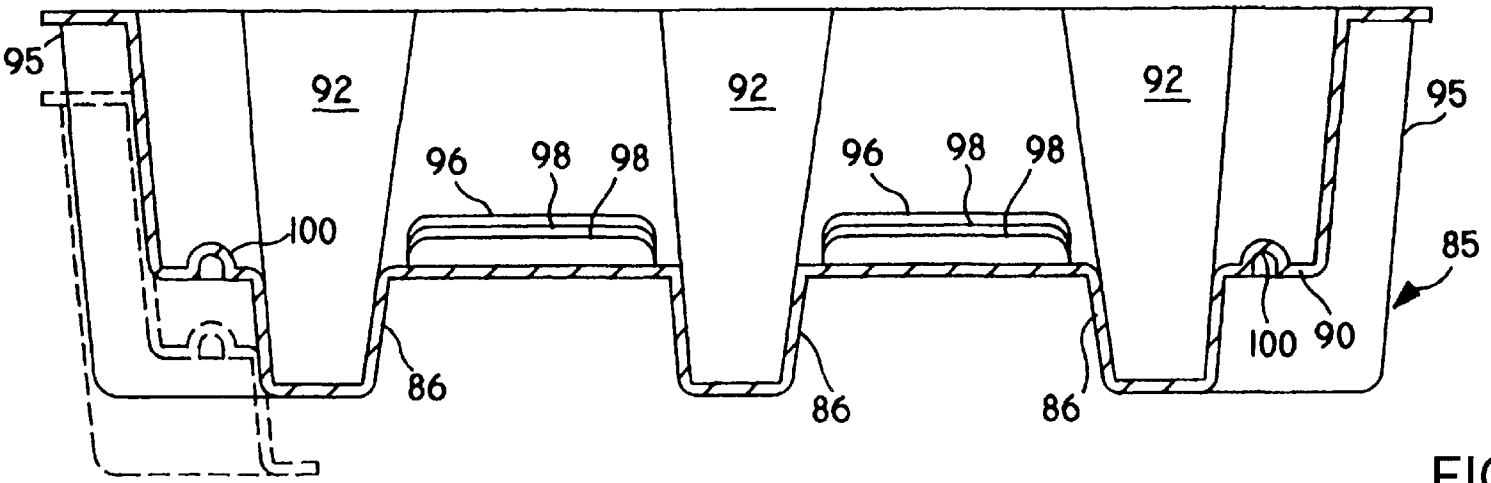
FIG. 9 is a side cross sectional view of the speaker receiving IPC structure with the cross section taken along a center line in the longitudinal direction of the IPC structure.
Figure 10:
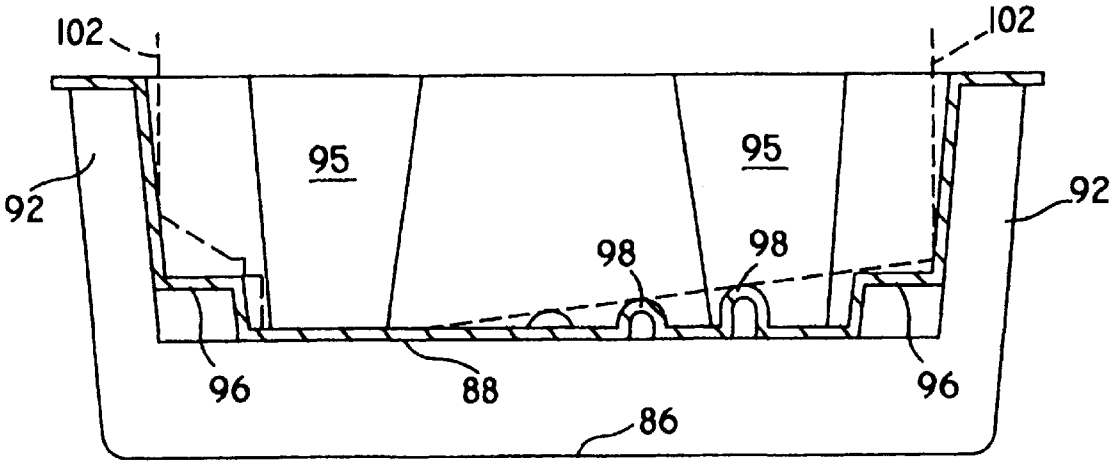
FIG. 10 is an end cross sectional view of the speaker receiving IPC structure in the direction of the arrows on line 10—10 of FIG. 8.

An interior package cushion structure for receiving and cushioning speakers in a speaker shipping package is illustrated in FIGS. 8–10. In this example the speaker receiving IPC structure 85 is formed with major lateral ribs 86 which define plateaus 88 between the ribs 86 and shelves 90 that form portions of the cavity wall for receiving the speaker. The lateral ribs 86 intersect at respective ends with vertical ribs 92 which extend at right angles to the lateral ribs 86. The lateral ribs 86 at the respective ends of the cavity also merge with orthogonal rib sections 94 which extend in a third orthogonal direction. The ribs 86,92,94, and 95 provide three dimensional rib reinforcement effectively forming a crushable "rib cage" around the cavity structure. The orthogonal rib sections 94 intersect with additional vertical ribs 95 at the ends of the IPC structure. Additional shelves 96 and narrow ribs 98 may be formed in the plateaus 88 providing additional relief in the cavity walls to strengthen the cavity walls, provide product protection, and accommodate any irregular shapes in the speaker to be fitted in the cavity.

A nesting configuration of successive speaker receiving IPC structures facing in the same direction is illustrated in ghosted outline at the left side of FIG. 9. Denesting lugs 100 may be added to shelves 90 to prevent locking engagement of nested structures. The cavity ribs 98 may similarly perform a denesting function. The primary function of the cavity ribs 98 is in supporting a product 102 seated in the cavity on the cavity wall plateaus 88 as illustrated in FIG. 10.

Figure 11:
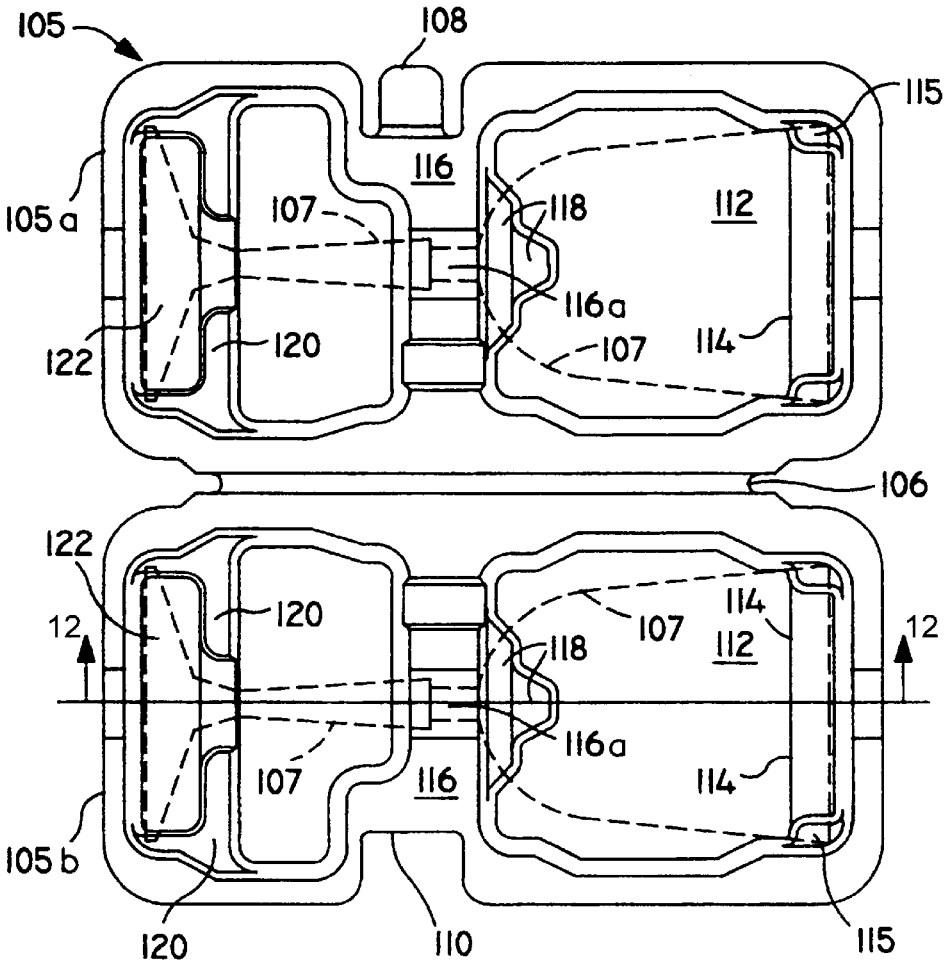
FIG. 11 it is a plan view from above of the two halves of a wine glass receiving IPC structure for a wine glass shipping package.
Figure 12:
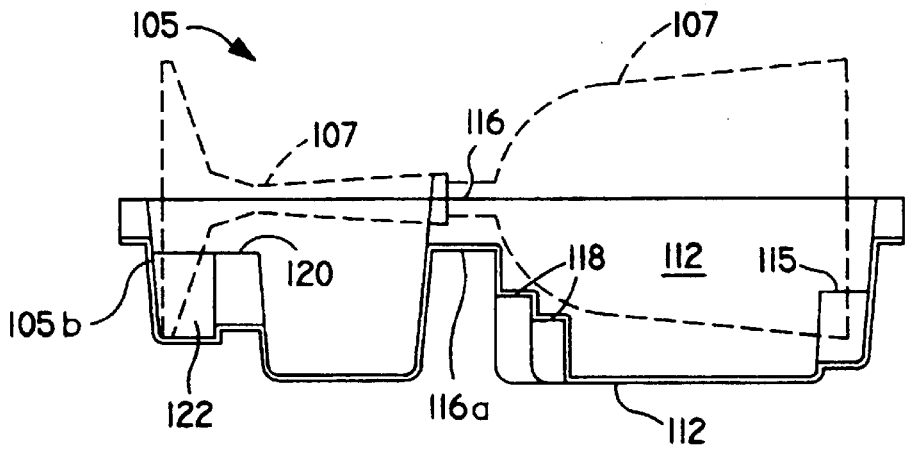
FIG. 12 is a side cross section view taken along the center line through one of the halves of the wine glass receiving IPC structure.

An IPC structure 105 for shipping wine glasses in a wine glass shipping package is illustrated in FIGS. 11–12. The wine glass shipping IPC structure consists of two mirror image half IPC structures 105*a* and 105*b* hinged together by an integrally molded, molded pulp fiber hinge 106 for enclosing a wine glass 107 in the IPC structure 105. A tab 108 is provided to secure the wine glass receiving IPC structure in closed position through the tab receiving opening 110.

The major features of the wine glass shipping IPC structure include a wine glass globe receiving and enclosing cavity 112 formed with a shelf 114 which engages the rim of the globe to offset the globe from the side wall 112 of the cavity. The cavity 112 is also formed with subsidiary shelves 115 at the upper corners.

Another major feature of the wine glass shipping IPC structure 105 is the stem supporting bridging rib 116 which crosses the halves 105*a* and 105*b* at approximately the center of the IPC structure. The bridging ribs 116 which cross the half IPC structures are formed with appropriate recesses 116*a* to accommodate the stem of the wine glass. While the bridging rib 116 is a horizontal rib, it is supported or reinforced by selected vertical ribs 118 extending from the side of the bridge rib 116 into the cavity 112.

At the lower end of each half IPC structure 105*a*,105*b* there is formed a bridge rib 120 extending across the half IPC structure adjacent to a recessed rib 122 for receiving and accommodating the base of the wine glass. The combination of structural shapes in the wine glass shipping IPC structure 105 including the cavity shelves 114,115, stem bridging rib 116, base support bridging rib 120 and recess rib 122 provide distributed product protection, absorbing impact shocks and vibrations and distributing impact shocks and vibrations that are transmitted, to the regions of the wine glass structure best able to withstand them.

By way of example the wine glass shipping IPC structure was designed to achieve product protection approaching a design limit or threshold of 60 g's shock acceleration from a five foot drop. The deployment of crushable structured geometric shapes and configurations as illustrated in FIGS. 11 and 12 with a molded pulp fiber shell caliper of 60 thousandths of an inch (0.060") (0.15 cm) achieve the required crushability and cushioning absorption of energy for predictable and reliable product protection at the design limit threshold.

Figure 13:
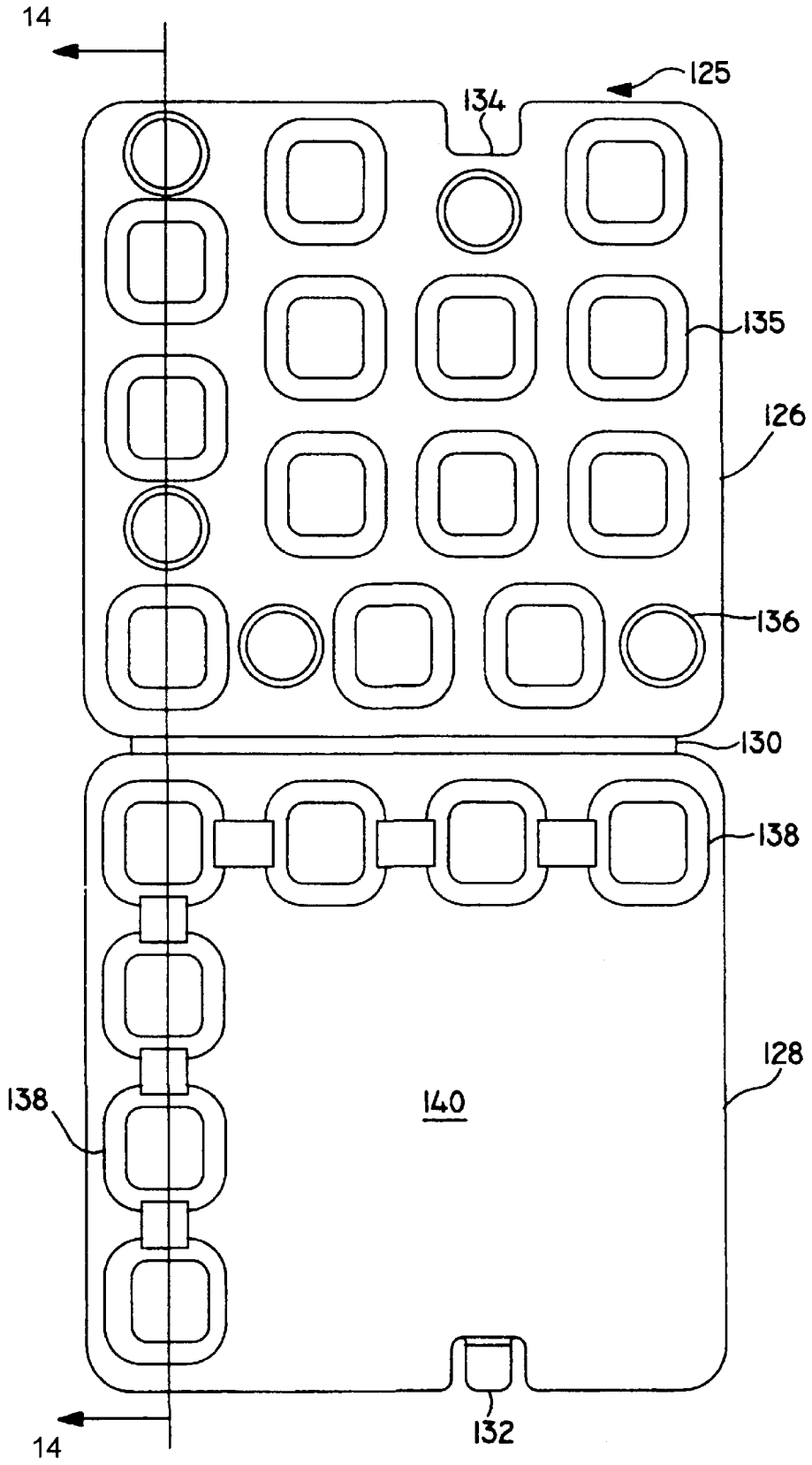
FIG. 13 is a plan view from above of the two hinged halves of a corner protector in open position.
Figure 14:
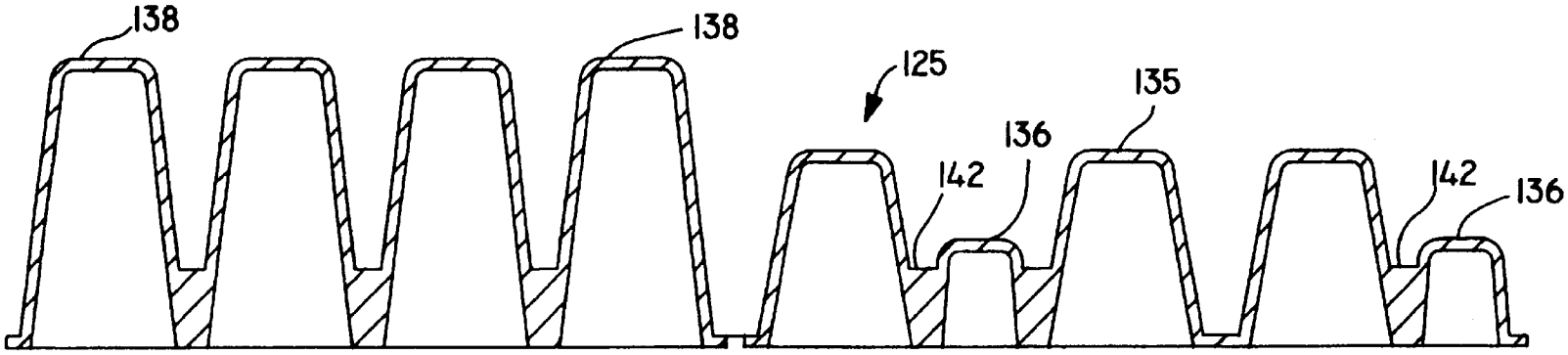
FIG. 14 is a side cross section view through the two hinged halves of the corner protector in open position in the direction of the arrows on line 14—14 of FIG. 13.
Figure 16:
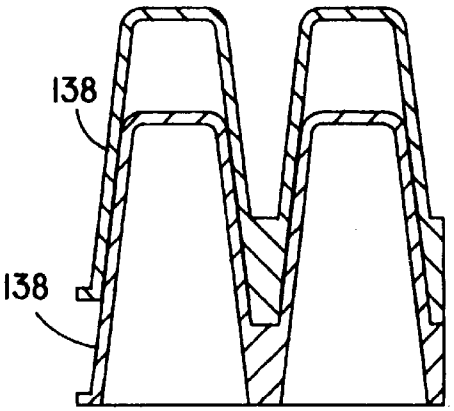
FIG. 16 is a fragmentary side cross section view through a portion of one of the halves of two corner protectors in open position and nested back to front and showing the denesting function of the pod fillets.
Figure 15:
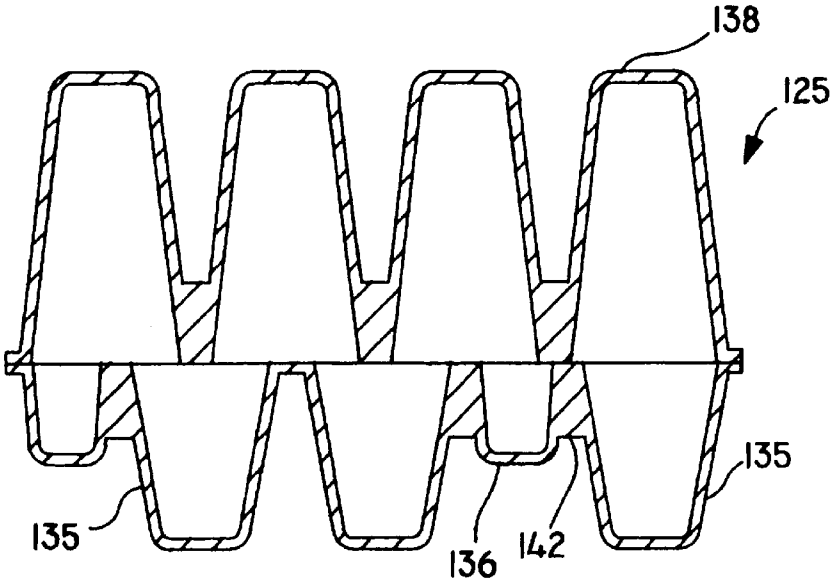
FIG. 15 is a side cross section view through the two hinged halves of the corner protector in closed position ready for deployment at the corner of a package.

A corner protector IPC structure 125 is illustrated in FIGS. 13–16. The corner protector 125 is formed with an outer base 126 and an inner base 128 joined together at a flexible molded pulp fiber hinge 130. The corner protector 125 is shown in open position in FIGS. 13 and 14 for stacking as shown in FIG. 16. In the operative closed position as shown in FIG. 15, the outer and inner bases 126, 128 are joined together by the complementary tab 132 and tab notch 134. The corner protector 125 is formed with an array of pods 135, 136 in the outer base 126 and pods 138 in the inner base 128. The corner protector 125 with its outer and inner bases 126,128 and array of pods 135,136,138 is essentially constructed in a corner cube configuration for seating at the corners of a package and defining a corner cube space 140 for fitting over the corner of a product or a corner of a stack of IPC structures to be shipped in the package. The corner protectors are constructed to support a product or a stack of products contained in IPC structures, spacing the contents from the corners of the package. Corner protectors may be inserted at all corners of the package.

The array of structural pods projecting from the base 126 of the corner protector 125 incorporates a first set of pods 135 molded with a first selected depth, and a second set of pods 136 molded with a second selected depth less than the first. The array of pods 135,136 may project from one side of the base 126. The first set of pods 135 presents a first level of crushability with a lesser resistance to crushing from corner drop, edge drop, and face drop impacts for absorbing impact shock and transport vibrations. As the first set of pods 135 are crushed to the depth of the second set of pods 136, the second set of pods present a second level of crushability with a greater resistance to further crushing. The configuration of the corner protector 125 therefore provides two different sequential levels of resistance to crushing by mechanical shock, vibrations, and stacking and loading forces.

The corner protector 125 may be further reinforced by depositing fillets 142 of fiber material in the valleys between the outsides of pods 135,136 in the array. The fillets 142 substantially increase resistance to hinging or bending at the valleys between pods and resistance to lateral and longitudinal crushing. The fillets or gussets 142 effectively add a third level of crushability with even greater resistance to further crushing from mechanical impacts for absorbing impact shock and transport vibrations with higher levels of shock acceleration. In this example, the fillets buildup the thickness of molded fiber material at the valleys between pods to approximately ⅜" (0.9 cm) to provide this third level of crushability.

The larger pods 138 formed on the inner base 128 of corner protector 125 add yet another controllable parameter for crushability and cushioning absorption of energy. The larger pods 138 face the product or stack of IPC structures and may be constructed, for example, to afford the greatest crushing compliance and least resistance to crushing for product protection. It is apparent, in any event, that the array of different size pods of the corner protector of FIGS. 13–16 affords multiple levels of crushability and absorption of energy for multiple impacts or successive impacts at different shock accelerations for meeting the requirements of different design limits and thresholds.

According to another embodiment of the invention, the array of pods 135,136,138 and fillets 142 formed on the bases 126,128 of corner protector 125 may also be molded directly into molded pulp fiber IPC structures for shipping relatively heavy but delicate and sensitive equipment such as television sets and other electronic equipment. In this embodiment of the invention the array of pods as illustrated in FIGS. 13 and 14 is formed at locations distributed around a product receiving cavity for relatively heavy products and equipment with relatively delicate sensitive elements. The array of pods 135,136,138 and fillets 142 design into the IPC structure multiple levels of crushability affording multiple levels of product protection. The multilevel pod array is constructed to provide the requisite crushability and cushioning absorption of energy for product protection at multiple design limits and thresholds for shock acceleration at which damage or breakage to sensitive elements may occur. As impact shock accelerations approach the respective design limits and thresholds, successive crushing and absorption of energy reduces transmission of shock accelerations to the product within acceptable limits.

Figure 17:
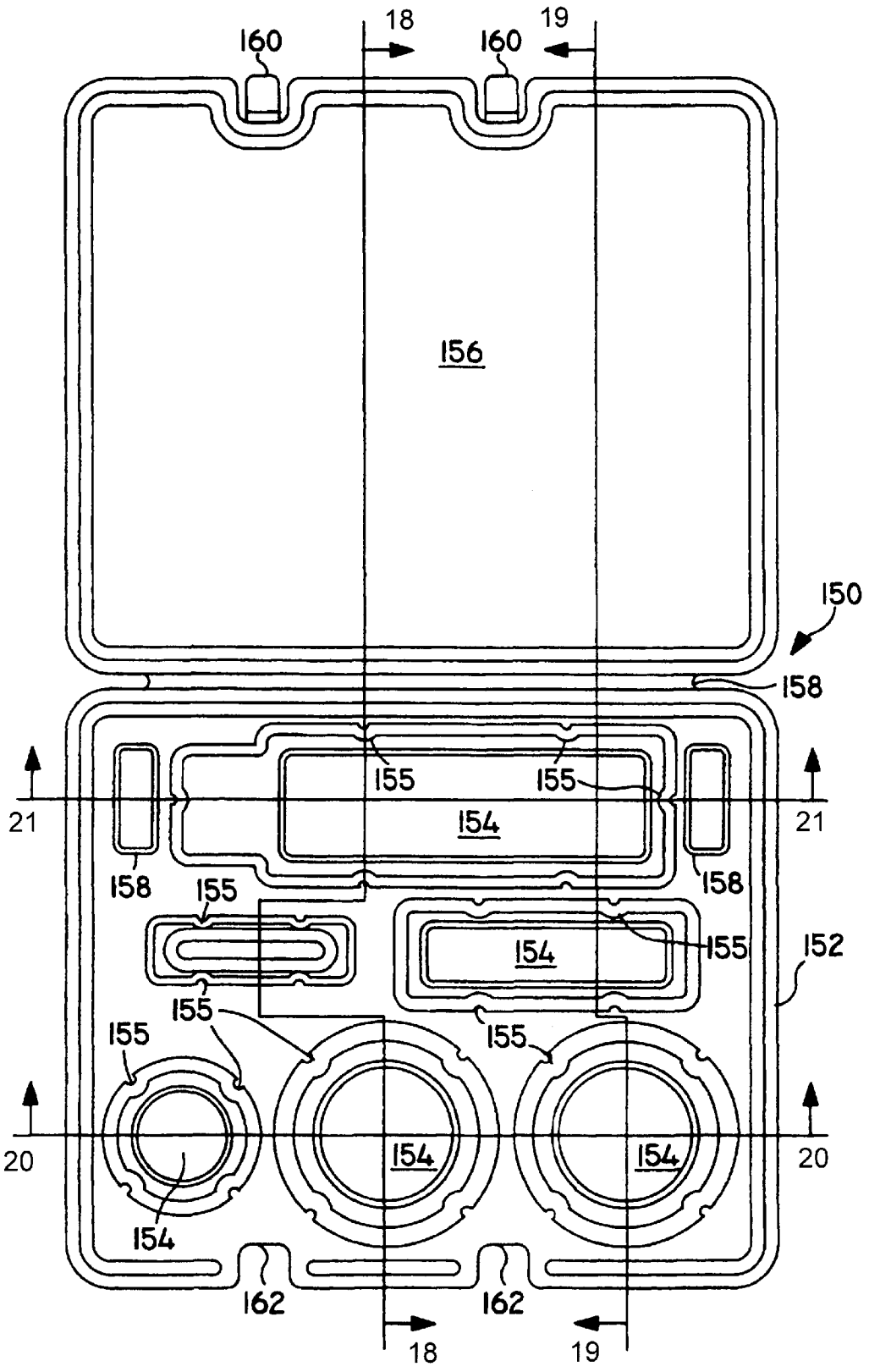
FIG. 17 is a plan view of a large cosmetic kit tray IPC structure with hinged cover in open position showing friction fit cavities with crush ribs for receiving the large cosmetic kit articles by forcible insertion and for protecting the articles from vibrations.
Figure 18:
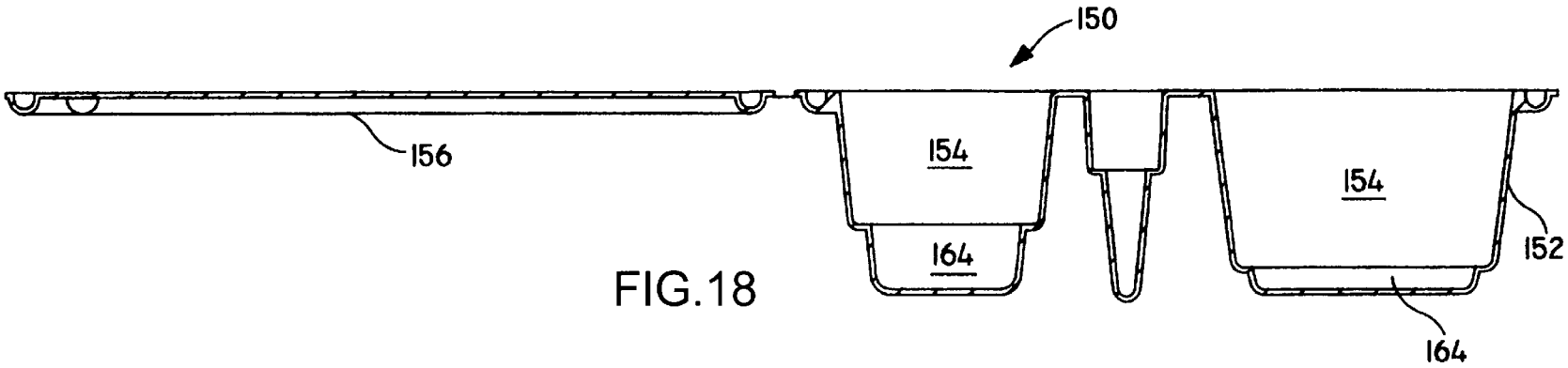
FIGS. 18 and 19 are side cross section views through the large cosmetic kit tray in open position in the direction of the arrows on line 18—18 and line 19—19 respectively on FIG. 19.
Figure 19:
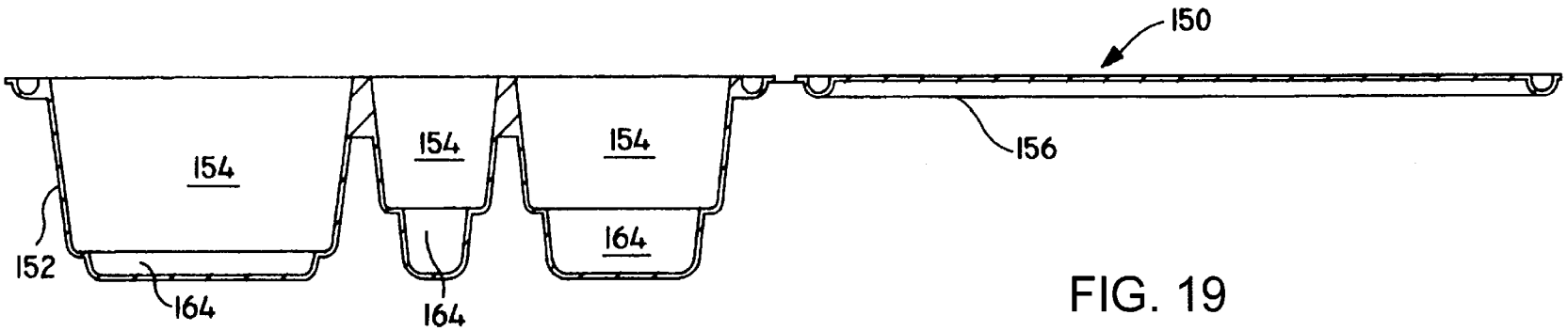
Figure 20:
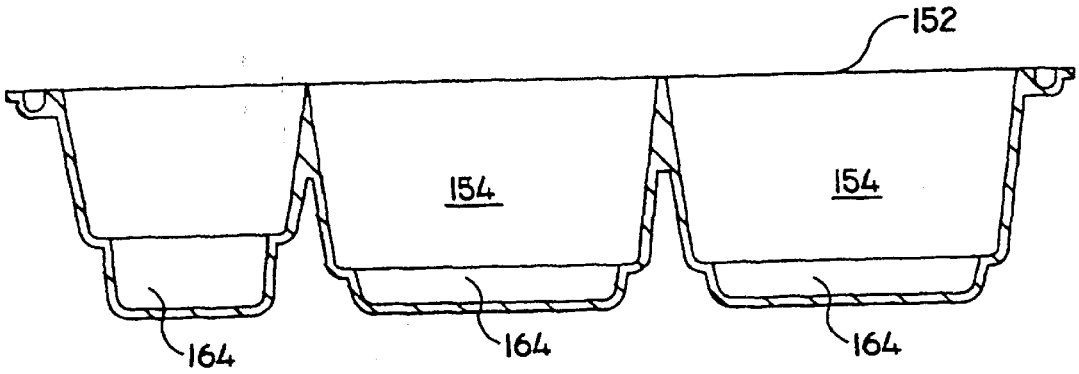
FIGS. 20 and 21 are side cross section views through the large cosmetic kit tray in the direction of the arrows on line 20—20 and line 21—21respectively of FIG. 17.
Figure 21:
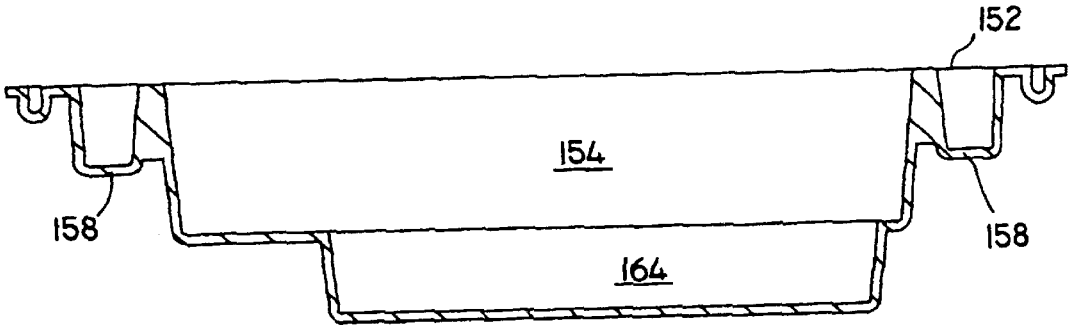
Figure 22:
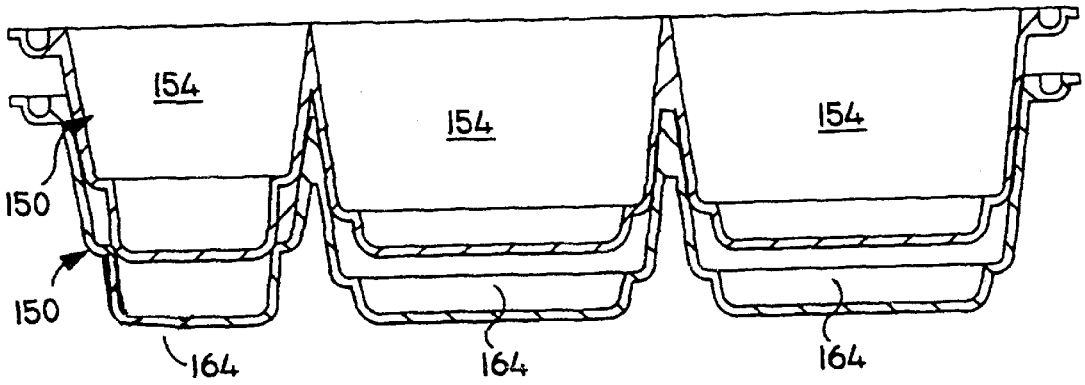
FIG. 22 is a side cross section view of multiple large cosmetic kit tray IPC structures in nesting position in the direction of the arrows on line 21—21 of FIG. 17.

A large cosmetic kit tray IPC structure 150 is illustrated in FIG. 17 reshowing the use of friction fit pockets and crush ribs. The large cosmetic kit tray includes a base 152 formed with friction fit pockets 154 for receiving and containing bottles, jars, and other containers of cosmetic materials. The crush fit cavities 154 are formed with crush ribs 155 as hereafter described. The large cosmetic kit tray 150 is formed with a cover 156 hingedly connected to the base 152 by a flexible molded pulp fiber hinge 158.

As shown in FIG. 17, each of the product receiving friction fit cavities 154 is formed with a plurality of crush ribs 155 protruding into the cavity or pocket 154. The juxtaposed crush ribs 155 define a pocket width less than the width dimension of a product to be inserted and contained in the pocket 154. In order to place a cosmetic beauty product in the respective pocket 154, it is forcibly inserted. The forcible insertion may have two effects. The primary effect is to cause breaking, tearing, or parting of fibers in the respective crush ribs 155. The crush ribs are permanently deformed in the process of forcible insertions. Second, the forcible insertion also causes some widening of the pocket 154 itself stressing pocket fibers and perhaps in some instances causing some breaking or parting of the pocket fibers.

It has been found that the condition of partial rupturing and parting of fibers of the crush ribs 155 and perhaps to some extent the deformation of fibers of the pocket 154 provides an effective structure for critically damping vibrations imparted to the package by the mode of transportation and for isolating the cosmetic beauty products from the forced vibrations. The deformed crush ribs 155 also serve to provide secure retention of the products in the respective pockets.

According to other features of the large cosmetic kit tray 150 of FIG. 17, ribs 158 are provided at the ends of one of the elongate crush fit pockets 154 to provide further product protection. The cover 156 on hinge 158 is secured in place by tabs 160 which engage tab notches 162. The cavities 154 are formed with pods 164 for supporting the tray on a base and for stacking trays on each other with pods of one tray resting on the cover of another tray.

The testing procedures and testing criteria for establishing the design requirements for molded pulp fiber IPC structures according to the invention are described in the article "ASTM and NSTA: Testing Criteria We Can Live With" *The LAB INNOVATOR, Volume* 2, *No.* 2, June, 1992 Published by LAB, 1326 New Skaneateles Turnpike, Skaneateles, N.Y. 13152-8801. This article provides a general description of ASTM and NSTA test procedures and requirements. The test procedures of the National Safe Transit Association are set forth in "Test Procedure Project 1A" Published by the National Safe Transit Association, P.O. Box 10744, Chicago, Ill. 60610-0744.

While the invention has been described with reference to particular example embodiments, it is intended to cover all variations and equivalents within the scope of the following claims.

We claim:

1. A new method of interior package cushioning for protecting products shipped in a package comprising:

forming at least one molded pulp fiber interior package cushioning (IPC) structure defining a cavity for receiving and holding a product to be shipped;

forming a plurality of structural ribs in the form of elongate hollow ridges molded in the IPC structure and extending between different locations on the IPC structure for reinforcing the IPC structure between the locations, said IPC structure comprising intersecting ribs extending in at least two orthogonal directions or axes relative to each other;

forming said ribs to function as crushable structures positioned and distributed around the cavity of the IPC structure for crushing and absorbing energy in response to accelerations approaching a design limit or threshold acceleration;

loading a product in the cavity and packing the IPC structure in a package for shipping;

protecting a product in the cavity of the IPC structure shipped in the package by crushing and absorbing energy at said rib crushable structures in response to mechanical shock acceleration caused by corner drops, edge drops, face drops, and horizontal impacts of the package, and in response to vibration acceleration imparted to the package by transport modes, for accelerations approaching a design limit or threshold acceleration at which damage or breakage may occur to a sensitive element of the product shipped in the package;

and forming a friction fit cavity with crush ribs protruding into the cavity, said crush ribs defining at least one cavity width dimension less than a corresponding width dimension of a product to be contained in the cavity, and partially crushing fibers of the crush ribs upon forcing a product into the friction fit cavity, to provide an inelastic vibration damping friction fit cavity and crush rib combination structure.

2. The method of claim 1 comprising forming a cavity as a suspended pocket, suspended between elongate support ribs, said suspended pocket and support ribs being constructed to contain and support a product by suspension in the suspended pocket so that no part of the product or suspended pocket contacts the external package or other IPC structures during shipping and handling.

3. The method of claim 1 comprising forming a plurality of structural pods in the form of hollow recesses or wells substantially symmetrical in cross section and molded with selected depths in the IPC structure at selected locations;

forming said pods to function as crushable structures positioned and distributed around the cavity to provide additional protection for a product in the cavity;

and protecting the product in the cavity by crushing and absorbing energy at said pod crushable structures in response to mechanical shock and vibration acceleration approaching a design limit or threshold acceleration at which damage or breakage may occur to a sensitive element of the product shipped in a package.

4. A new structure for interior package cushioning to protect products shipped in a package comprising:

at least one molded pulp fiber interior package cushioning (IPC) structure formed with at least one cavity defining a cavity surface for receiving and holding a product to be shipped;

said IPC structure comprising a plurality of structural ribs in the form of elongate hollow ridges molded in the IPC structure and extending between different locations on the IPC structure for reinforcing the IPC structure between the locations, said structural ribs of the IPC structure comprising intersecting ribs extending in two orthogonal elongate directions relative to each other;

a product having a breakable element held in said cavity contacting the cavity surface, said breakable element being subject to breakage at a threshold acceleration;

said structural ribs comprising crushable structures positioned and distributed around the cavity of the IPC structure with the bottoms of the structural ribs being spaced from the cavity surface and being constructed for protecting a product held in the cavity by crushing and absorbing energy in response to any mechanical shock and vibration accelerations imparted to the package exceeding said threshold acceleration and by limiting accelerations transmitted to the product to accelerations up to said threshold acceleration;

a friction fit cavity formed with crush ribs protruding into the cavity, said crush ribs defining at least one cavity width dimension less than a corresponding width dimension of a product to be contained in the cavity, said friction fit cavity and crush ribs being constructed to cause partial crushing of fibers of the crush ribs upon forcing a product into the friction fit cavity, to provide an inelastic vibration damping friction fit cavity ad crush rib combination structure.

5. The structure of claim 4 wherein the cavity comprises a suspended pocket, suspended between elongate support ribs, said suspended pocket and support ribs being constructed to contain and support a product by suspension in the suspended pocket so that no part of the product or suspended pocket contacts the external package or other IPC structures during shipping and handling.

6. A new structure for interior package cushioning to protect products shipped in a package comprising:

a plurality of molded pulp fiber interior package cushioning (IPC) structures each formed with a plurality of cavities, each cavity defining at least one cavity surface for receiving and holding a product to be shipped;

said IPC structures each comprising a plurality of structural ribs in the form of elongate hollow ridges molded in the IPC structure and extending between different locations on the IPC structure for reinforcement between the locations;

a plurality of products each having a breakable element, said products being held in said cavities contacting the respective cavity surface, said breakable elements being subject to breakage at a threshold acceleration;

said structural ribs comprising crushable structures positioned and distributed around the cavities of the IPC structure with the bottoms of the structural ribs being spaced from the respective cavity surfaces for protecting products held in the cavities, said structural ribs being constructed to crush and absorb energy in response to any mechanical shock and vibration accelerations imparted to the package exceeding said threshold acceleration and to limit accelerations transmitted to the products to accelerations up to said threshold acceleration;

said IPC structures comprising a plurality of structural pods in the form of hollow recesses or wells each being substantially symmetrical in cross section around a central axis and being molded with selected depths in the IPC structure at different locations, said structural pods comprising crushable structures positioned and distributed around the cavities of the IPC structure with the bottoms of the pods being spaced from the respective cavity surfaces to provide additional protection for a product held in the cavity by crushing and absorbing energy in response to any mechanical shock and vibration accelerations imparted to the package exceeding said threshold acceleration and by limiting accelerations transmitted to the product to accelerations up to said threshold acceleration, and for directing stacking and loading forces;

said pods including at least one array of pods comprising at least three pods spaced closely together adjacent to each other forming valleys between the pods of the array on the outside of the array of pods, said array of pods being positioned on the IPC structure to enhance product protection, and resist crushing;

said array of pods being formed with fillets of molded pulp fiber deposited in the valleys between adjacent pods on the outside of the array of pods forming a thickness of molded pulp fiber in said valleys greater than the thickness of molded pulp fiber at the adjacent pods, said fillets filling a portion of the valleys between adjacent pods partially joining the pods together for adjusting the crushability of the array of pods by increasing resistance to crushing and hinging or bending at the valleys between adjacent pods;

said pods being tapered in cross section from a greater cross section area dimension at the opening of the recess or well of the pod to a smaller cross section area dimension at the bottom of the recess or well, said taper being substantially symmetrical about a central axis of the pod;

said structural ribs comprising crushable structures positioned and distributed around the cavities of the IPC structure with the bottoms of the structural ribs being spaced from a friction fit cavity formed with crush ribs protruding into the cavity, said crush ribs defining at least one width dimension less than a corresponding width dimension of a product to be contained in the cavity, said friction fit cavity and crush ribs being constructed to cause partial crushing of fibers of the crush ribs upon forcing a product into the friction fit cavity, to provide an inelastic vibration damping and isolating friction fit cavity and crush rib combination structure.

7. The structure of claim 6 wherein the cavity comprises a suspended pocket, suspended between elongate support ribs, said suspended pocket and support ribs being constructed to contain and support a product by suspension in the suspended pocket so that no part of the product or suspended pocket contacts the external package or other IPC structures during shipping and handling.

8. A new structure for interior package cushioning to protect one or more products shipped in a package comprising:

a tray of molded pulp fiber having one or more cavities each for receiving and holding a product;

one or more products held in said one or more cavities, each product having a breakable element subject to breakage at a threshold acceleration;

one or more structural ribs each in the form of an elongate hollow ridge in the tray for reinforcing the tray; and at least one structural rib comprising a podded rib formed with at least three pods in the form of hollow recesses substantially symmetrical in cross section around a central axis and closely spaced adjacent to each other, the podded rib being positioned on the tray to crush and absorb energy transmitted to the package when the package is subjected to acceleration equal to or greater than the threshold acceleration, thereby reducing the amount of force transmitted to the products due to acceleration to less than the force generated by the threshold acceleration.

9. The structure according the claim 8, wherein the pods have a depth greater than the depth of the structural rib in which the pods are formed.

10. The structure according to claim 8, wherein the structure weighs less than the products.

11. The structure according to claim 8, further comprising a package for holding one or more of the structures holding the products being shipped.

12. The structure according to claim 11, wherein when the package is subjected to force, the structure transfers the force to a relatively strong part of a product being shipped.

13. A new structure for interior package cushioning to protect one or more products shipped in a package, comprising:

a tray of molded pulp fiber having one or more cavities each for receiving and holding a product;

one or more products held in said one or more cavities, each product having a breakable element subject to breakage at a threshold acceleration;

one or more structural ribs each in the form of an elongate hollow ridge in the tray for reinforcing the tray; and at least one structural rib comprises a podded rib formed with a row of at least three pods in the form of hollow recesses substantially symmetrical in cross section around a central axis and closely spaced adjacent to each other in a linear sequence, the podded rib being positioned on the tray to crush and absorb energy transmitted to the package when the package is subjected to acceleration equal to or greater than the threshold acceleration, thereby reducing the amount of force transmitted to the products due to acceleration to less than the force generated by the threshold acceleration.

14. The structure according to claim 13, wherein the pods have a depth greater than the depth of the cavities.

15. The structure according to claim 13, further comprising a package for holding one or more of the structures holding the products being shipped.

16. The structure according to claim 15, wherein when the package is subjected to force, the structure transfers the force to a relatively strong part of a product being shipped.

17. A new structure for interior package cushioning to protect one or more products shipped in a package, comprising:

a tray of molded pulp fiber having one or more cavities each for receiving and holding a product;

one or more products held in said one or more cavities, each product having a breakable element subject to breakage at a threshold acceleration; and a plurality of structural pods in the tray comprising at least three pods closely spaced adjacent to each other and positioned on the tray to crush and absorb energy transmitted to the package when the package is subjected to acceleration equal to or greater than the threshold acceleration, thereby reducing the amount of force transmitted to the products due to acceleration to less than the force generated by the threshold acceleration.

18. The structure according to claim 17, wherein the pods have a depth greater than the depth of the cavities.

19. The structure according to claim 17, wherein the pods are arranged in a linear sequence.

20. The structure according to claim 17, further comprising a package for holding one or more of the structures holding the products being shipped.

21. The structure according to claim 20, wherein when the package is subjected to force, the structure transfers the force to a relatively strong part of the product being shipped.

22. A new structure for interior package cushioning to protect products shipped in a package comprising:

at least one molded pulp fiber interior package cushioning (IPC) structure formed with at least one cavity defining a cavity surface for receiving and holding a product to be shipped;

the IPC structure comprising a plurality of structural ribs in the form of elongate hollow ridges molded in the IPC structure and extending between different locations on the IPC structure for reinforcing the IPC structure, the structural ribs of the IPC structure comprising intersecting ribs extending in two orthogonal elongate directions relative to each other;

a product having a breakable element held in the cavity contacting the cavity surface, the breakable element being subject to breakage at a threshold acceleration;

a package for holding at least one IPC structure holding the product to be shipped;

the structural ribs further comprising crushable structures positioned and distributed around the cavity of the IPC structure with the bottoms of the structural ribs being spaced from the cavity surface and being constructed for protecting a product held in the cavity by crushing and absorbing energy in response to any mechanical shock and vibration accelerations imparted to the package exceeding the threshold acceleration and by limiting accelerations transmitted to the product to accelerations up to the threshold acceleration.

23. The structure of claim 22 wherein the IPC structure comprises a plurality of structural pods in the form of hollow recesses or wells each being substantially symmetrical in cross section around a central axis and being molded with selected depths in the IPC structure at selected locations, the pods comprising crushable structures positioned and distributed around the cavity of the IPC structure with the bottoms of the pods being spaced from the cavity surface to provide additional protection for a product held in the cavity by crushing and absorbing energy in response to any mechanical shock and vibration accelerations imparted to the package exceeding the threshold acceleration and by limiting accelerations transmitted to the product to accelerations up to the threshold acceleration.

24. The structure of claim 23 wherein the plurality of structural pods comprises a row of at least three pods closely spaced adjacent to each other in a linear sequence forming valleys between the pods of the row on the outside of the row of pods, the row of pods being positioned on the IPC structure to enhance product protection from mechanical shock and vibration accelerations and to direct stacking and loading forces around products contained in the cavities.

25. The structure of claim 24 wherein the row of pods is formed in a rib, the row of pods being wholly contained within the rib and being arranged in a linear sequence aligned in the same direction along the rib, the rib and row of pods sharing common walls and forming an integral podded rib structure.

26. The structure of claim 22 wherein at least one structural rib of the IPC structural comprises a podded rib formed with a row of pods of at least three structural rib pods in the form of hollow recesses or wells each being substantially symmetrical in cross section around a central axis and being molded with a selected depth less than the full depth of the podded rib in the IPC structure, the row of rib pods being wholly contained within the podded rib, the podded rib and row of rib pods sharing common walls and forming an integral podded rib structure, the rib pods comprising crushable structures closely spaced adjacent to each other in a linear sequence aligned in the same direction along the podded rib, forming valleys between the rib pods of the row on the outside of the podded rib, the rib pods providing additional protection for a product in the cavity from mechanical shock and vibration accelerations and stacking and loading forces, the rib pods being constructed to adjust the crushability of the podded rib by increasing resistance to crushing of the podded rib.

27. The structure of claim 22 wherein the cavity comprises a suspended pocket suspended between elongate support ribs and constructed to contain and support a product by suspension so that no part of the product or suspended pocket contacts the package or other IPC structures during shipping and handling.

28. A new structure for interior package cushioning to protect products shipped in a package comprising:

a plurality of molded pulp fiber interior package cushioning (IPC) structures each formed with a plurality of cavities, each cavity defining at least one cavity surface for receiving and holding a product to be shipped;

the IPC structures each comprising a plurality of structural ribs in the form of elongate hollow ridges molded in the IPC structure and extending between different locations on the IPC structure for reinforcement;

a plurality of products each having a breakable element, the products being held in the cavities contacting the respective cavity surface, the breakable elements being subject to breakage at a threshold acceleration;

a package for holding a plurality of IPC structures holding products to be shipped;

the structural ribs comprising crushable structures positioned and distributed around the cavities of the IPC structure with the bottoms of the structural ribs being spaced from the respective cavity surfaces for protecting products held in the cavities, the structural ribs being constructed to crush and absorb energy in response to any mechanical shock and vibration accelerations imparted to the package exceeding the threshold acceleration and to limit accelerations transmitted to the products to accelerations up to the threshold acceleration;

the IPC structures comprising a plurality of structural pods in the form of hollow recesses or wells each being substantially symmetrical in cross section around a central axis and being molded with selected depths in the IPC structure at different locations, the structural pods comprising crushable structures positioned and distributed around the cavities of the IPC structure with the bottoms of the pods being spaced from the respective cavity surfaces to provide additional protection for a product held in the cavity by crushing and absorbing energy in response to any mechanical shock and vibration accelerations imparted to the package exceeding the threshold acceleration and by limiting accelerations transmitted to the product to accelerations up to the threshold acceleration, and for directing stacking and loading forces;

the pods including at least one array of pods comprising at least three pods spaced closely together adjacent to each other forming valleys between the pods of the array on the outside of the array of pods, the array of pods being positioned on the IPC structure to enhance product protection, and resist crushing;

the array of pods being formed with fillets of molded pulp fiber deposited in the valleys between adjacent pods on the outside of the array of pods forming a thickness of molded pulp fiber in the valleys greater than the thickness of molded pulp fiber at the adjacent pods, the fillets filling a portion of the valleys between adjacent pods partially joining the pods together for adjusting the crushability of the array of pods by increasing resistance to crushing and to hinging or bending at the valleys between adjacent pods;

the pods being tapered in cross section from a greater cross section area dimension at the opening of the recess or well of the pod to a smaller cross section area dimension at the bottom of the recess or well, the taper being substantially symmetrical about a central axis of the pod.

29. The structure of claim 28 wherein at least one rib is formed with a row of pods comprising at least three rib pods closely spaced adjacent to each other in a linear sequence aligned in the same direction along the rib, the rib pods being substantially symmetrical in cross section about a central axis and molded with a selected depth less than the full depth of the rib, the rib pods being wholly contained within the rib, the rib and rib pods sharing common walls and forming an integral podded rib structure.

30. The structure of claim 28 wherein the cavity comprises a suspended pocket suspended between elongate support ribs and constructed to contain and support a product by suspension so that no part of the product or suspended pocket contacts the external package or other IPC structures during shipping and handling.

31. A new structure for interior package cushioning to protect products shipped in a package comprising:

at least one molded pulp fiber interior package cushioning (IPC) structure formed with at least one cavity defining a cavity surface for receiving and holding a product to be shipped;

a product having a breakable element held in the cavity contacting the cavity surface, the breakable element being subject to breakage at a threshold acceleration;

a package for holding at least one IPC structure holding the product to be shipped;

the IPC structure comprising a plurality of structural pods in the form of hollow recesses or wells each being substantially symmetrical in cross section around a central axis and being molded with selected depths in the IPC structure, the pods comprising crushable structures positioned and distributed around the cavity of the IPC structure with the bottoms of the pods being spaced from the cavity surface to provide protection for a product in the cavity, the pods being constructed to crush and absorb energy in response to any mechanical shock and vibration accelerations imparted to the package exceeding the threshold acceleration and to limit accelerations transmitted to the product to accelerations up to the threshold acceleration.

32. The structure of claim 31 wherein the IPC structure is formed with a plurality of structural pods comprising a row of at least three pods closely spaced adjacent to each other in a linear sequence forming valleys between the pods of the row on the outside of the row of pods, the row of pods being positioned on the IPC structure to enhance product protection from mechanical shock and vibration accelerations and stacking and loading forces.

33. The structure of claim 31 wherein the pods are tapered from a greater cross section area dimension at the opening of the recess or well to a smaller cross section area dimension at the bottom of the recess or well, the taper being substantially symmetrical about a central axis of the pod.

34. A new structure for interior package cushioning to protect products shipped in a package comprising:

at least one molded pulp fiber interior package cushioning (IPC) structure formed with at least one cavity defining a cavity surface for receiving and holding a product to be shipped;

a package for holding at least one IPC structure holding a product to be shipped;

the IPC structure comprising a plurality of structural ribs in the form of elongate hollow ridges molded in the IPC structure and extending between different locations on the IPC structure for reinforcing the IPC structure;

the structural ribs comprising crushable structures positioned and distributed around the cavity of the IPC structure with the bottoms of the structural ribs being spaced from the cavity surface and being constructed for protecting a product held in the cavity by crushing and absorbing energy in response to any mechanical shock and vibration accelerations imparted to the package exceeding the threshold acceleration and by limiting accelerations transmitted to the product to accelerations up to the threshold acceleration;

the structural ribs molded in the IPC structure being arranged for nesting of a plurality of IPC structures facing in the same direction thereby minimizing the space requirements for shipping the IPC structures without products in the respective cavities, the structural ribs and the at least one cavity being molded with respective recesses being formed in the same depth direction;

the IPC structure comprising a plurality of structural pods in the form of hollow recesses or wells each being substantially symmetrical in cross section around a central axis and being molded with selected depths in the IPC structure at selected locations, the pods comprising crushable structures positioned and distributed around the cavity of the IPC structure with the bottoms of the pods being spaced from the cavity surface to provide additional protection for a product held in the cavity by crushing and absorbing energy in response to any mechanical shock and vibration accelerations imparted to the package exceeding the threshold acceleration and by limiting accelerations transmitted to the product to accelerations up to the threshold acceleration, the structural pods being molded with respective recesses formed in the same depth direction as the recesses of the structural ribs and cavity;

at least one of the structural ribs of the IPC structure comprising a podded rib formed with a row of pods of at least three structural rib pods in the form of hollow recesses or wells each being substantially symmetrical in cross section around a central axis, the row of rib pods being wholly contained within the podded rib, the podded rib and row of rib pods sharing common walls and forming an integral podded rib structure, the rib pods being molded with a selected depth less than the full depth of the podded rib in the IPC structure, the rib pods comprising crushable structures closely spaced adjacent to each other in a linear sequence aligned in the same direction along the podded rib, forming valleys between the rib pods of the row on the outside of the podded rib, the rib pods providing additional protection for a product in the cavity from any mechanical shock and vibration acceleration and stacking and loading forces, the rib pods being constructed to adjust the crushability of the podded rib by increasing resistance to crushing of the podded rib;

the rib pods being joined by fillets of molded pulp fiber deposited in the valleys between adjacent rib pods on the outside of the row of rib pods having a thickness of molded pulp fiber in the valleys greater than the thickness of molded pulp fiber of the common walls;

the podded rib being molded with respectively recesses in the same depth direction as the plurality of structural ribs, plurality of structural pods, and cavity.

35. A new method of interior package cushioning for protecting products shipped in a package comprising:

forming at least one molded pulp fiber interior package cushioning (IPC) structure with at least one cavity defining a cavity surface for receiving and holding a product to be shipped;

forming a plurality of structural ribs in the form of elongate hollow ridges molded in the IPC structure and extending between different locations on the IPC structure for reinforcing the IPC structure;

forming the structural ribs to function as crushable structures positioned and distributed around the cavity of the IPC structure with the bottoms of the ribs being spaced from the cavity surface for crushing and absorbing energy in response to any mechanical shock and vibration accelerations imparted to the package exceeding a threshold acceleration;

loading and holding in the cavity a product having a breakable element, the breakable element being subject to breakage at the threshold acceleration;

packaging the IPC structure in a package for shipping;

protecting the product in the cavity of the IPC structure shipped in the package by crushing and absorbing energy at the rib crushable structures in response to any mechanical shock and vibration accelerations imparted to the package exceeding the threshold acceleration and by limiting accelerations transmitted to the product to accelerations up to the threshold acceleration.

36. The method of claim 35 comprising:

forming a plurality of structural pods in the form of hollow recesses or wells substantially symmetrical in cross section about a central axis and molded with selected depths in the IPC structure at selected locations;

forming the pods to function as crushable structures positioned and distributed around the cavity and with the bottoms of the pods being spaced from the cavity surface to provide additional protection for product in the cavity;

and protecting the product in the cavity by crushing and absorbing energy at the pod crushable structures in response to mechanical shock and vibration acceleration imparted to the package exceeding the threshold acceleration and by limiting accelerations transmitted to the product to accelerations up to the threshold acceleration.

37. The method of claim 36 comprising forming a row of at least three pods closely spaced adjacent to each other in a linear sequence forming valleys between adjacent pods of the row on the outside of the row of pods, the row of pods being positioned on the IPC structure to enhance product protection from mechanical shock and vibration accelerations and to direct stacking and loading forces around products contained in the cavities.

38. The method of claim 37 comprising forming the row of pods in a rib as an integral podded rib structure sharing common walls.

39. The method of claim 36 comprising forming at least one structural rib of the IPC structures as a podded rib formed with a row of at least three structural rib pods in the form of hollow recesses or wells substantially symmetrical in cross section around a central axis, forming the rib pods of the row adjacent to each other in a linear sequence aligned in the same direction along the podded rib, forming valleys between adjacent rib pods on the outside of the podded rib, the rib pods being molded with a selected depth less than the full depth of the rib in the IPC structure wholly containing the rib pods within the podded rib, forming the row of rib pods and podded rib as an integral podded rib structure sharing common walls, forming the podded rib to function as a crushable structure and depositing fillets of molded pulp fiber in valleys between the outsides of adjacent rib pods to desired thicknesses in the valleys greater than the thicknesses at adjacent rib pods filling a portion of the valleys between adjacent rib pods and partially joining the rib pods together for adjusting crushability of the podded rib by increasing resistance to crushing and bending or hinging at the valley between rib pods.

40. A new method of interior package cushioning for protecting products shipped in a package comprising:

forming a plurality of molded pulp fiber interior package cushioning (IPC) structures each with at least one cavity defining at least one cavity surface for receiving and holding a product to be shipped;

forming a plurality of structural ribs in the form of elongate hollow ridges molded in the IPC structure and extending between different locations on the IPC structures for reinforcement;

forming the structural ribs to function as crushable structures positioned and distributed around the cavity of each IPC structure with the bottom of the ribs being spaced from the respective cavity surface, for crushing and absorbing energy in response to accelerations impart to the package exceeding a threshold acceleration;

loading and holding in the cavities products having a breakable element, the breakable element being subject to breakage at the threshold acceleration;

stacking a plurality of loaded IPC structures in a package for shipping;

protecting the products in the cavities shipped in the package by crushing and absorbing energy at the rib crushable structures in response to any mechanical shock and vibration accelerations imparted to the package exceeding the threshold acceleration and by limiting accelerations transmitted to the product to accelerations up to the threshold acceleration;

forming a plurality of structural pods in the form of hollow recesses or wells substantially symmetrical in cross section around a central axis and molded with selected depths in the IPC structure at different locations;

forming the structural pods to function as crushable structures positioned and distributed around the cavity for crushing and absorbing energy in response to accelerations imparted to the package exceeding the threshold acceleration, the bottoms of the pods being spaced from the respective cavity surface to provide additional protection for a product in the cavity;

thereby protecting products shipped in the package by crushing and absorbing energy at the pod crushable structures in response to any mechanical shock and vibration accelerations in excess of the threshold acceleration;

forming a row of the structural pods in a rib comprising at least three pods arranged in a linear sequence and spaced closely together adjacent to each other forming valleys between adjacent pods on the outside of the row of pods, the row of pods being positioned on the IPC structure to enhance product protection, and resist crushing; and depositing fillets of molded pulp fiber in the valleys between adjacent pods on the outside of the array of pods to a desired thickness in the valleys greater than the thickness of molded pulp fiber of adjacent pods, filling a portion of the valleys between adjacent pods and partially joining the pods together for adjusting the crushability of the array of pods by increasing resistance to crushing and to hinging or bending at the valleys between adjacent pods.

41. The method of claim 40 comprising forming the rib pods as substantially symmetrical in cross section around a central axis and molding the rib pods with a selected depth less than the depth of the rib wholly containing the row of pods in the rib and forming the rib and row of pods as in integral podded rib structure sharing common walls.

42. A new method of interior package cushioning for protecting products shipped in a package comprising:

forming at least one molded pulp fiber interior package cushioning (IPC) structure with at least one cavity defining a cavity surface for receiving and holding a product to be shipped;

forming a plurality of structural pods in the form of hollow recesses or wells substantially symmetrical in cross section around a central axis and molded with selected depths in the IPC structure;

forming the pods to function as crushable structures positioned and distributed around the cavity with the bottoms of the pods being spaced from the cavity surface for crushing and absorbing energy in response to any mechanical shock and vibration accelerations exceeding a threshold acceleration;

loading in the cavity of the IPC structure a product having a breakable element, the breakable element being subject to breakage at the threshold acceleration;

packaging the IPC structure in a package; and protecting the product in the cavity shipped in the package at the pod crushable structures by crushing and absorbing energy in response to any mechanical shock and vibration accelerations imparted to the package exceeding the threshold acceleration and by limiting accelerations transmitted to the product to accelerations up to the threshold acceleration.

43. The method of claim 42 wherein the IPC structure is formed with at least one row of pods comprising at least three pods closely spaced adjacent to each other in a linear sequence forming valleys between adjacent pods on the outside of the row of pods, the row of pods being positioned on the IPC structure to enhance product protection from mechanical shock and vibration accelerations and stacking and loading forces and to resist crushing, and depositing fillets of molded pulp fiber in the valleys between adjacent pods on the outside of the row of pods to a desired thickness in the valleys greater than the thickness of the molded pulp fiber of adjacent pods filling a portion of the valleys between adjacent pods and partially joining the pods together for adjusting the crushability of the row of pods by increasing resistance to crushing and being or hinging at the valleys between pods.

* * * * *